US008534021B2

(12) United States Patent
Liu et al.

(10) Patent No.: US 8,534,021 B2
(45) Date of Patent: Sep. 17, 2013

(54) VARIABLE WIDTH MODULE OFFICE FURNITURE PARTITION

(75) Inventors: Ivan Liu, Markham (CA); David Parshad, Markham (CA); Peter Woronecki, Holland Landing (CA)

(73) Assignee: Inscape Corporation, Holland Landing, Ontario (CA)

( * ) Notice: Subject to any disclaimer, the term of this patent is extended or adjusted under 35 U.S.C. 154(b) by 77 days.

(21) Appl. No.: 13/373,084

(22) Filed: Nov. 4, 2011

(65) Prior Publication Data

US 2012/0311946 A1 Dec. 13, 2012

(30) Foreign Application Priority Data

Jun. 10, 2011 (CA) ..... 2742576

(51) Int. Cl.
*E04C 2/34* (2006.01)
*E04B 2/30* (2006.01)

(52) U.S. Cl.
USPC ..... 52/481.2; 52/489.2; 52/582.1; 52/64

(58) Field of Classification Search
USPC ..... 52/36.1, 239, 582.1, 584.1, 220.7, 52/476, 479, 481.1, 481.2, 483.1, 489.1, 52/489.2, 64
See application file for complete search history.

(56) References Cited

U.S. PATENT DOCUMENTS 2,904,991 A * 9/1959 Vaughan et al. ..... 52/242
4,905,428 A * 3/1990 Sykes ..... 52/126.4
5,233,802 A * 8/1993 Rogers ..... 52/212
5,406,760 A 4/1995 Edwards
5,408,796 A * 4/1995 Hashimoto et al. ..... 52/489.2
5,628,853 A 5/1997 Edwards
5,638,650 A 6/1997 Edwards
5,642,593 A * 7/1997 Shieh ..... 52/239
5,715,633 A * 2/1998 Raz et al. ..... 52/220.7
5,813,178 A 9/1998 Edwards
5,839,240 A * 11/1998 Elsholz et al. ..... 52/242
5,881,518 A 3/1999 Edwards et al.
5,913,787 A 6/1999 Edwards
6,088,981 A * 7/2000 Edwards ..... 52/239
6,158,180 A 12/2000 Edwards
6,286,275 B1 9/2001 Edwards
6,457,293 B1 * 10/2002 Tsai ..... 52/481.1
6,546,684 B2 * 4/2003 Waalkes et al. ..... 52/239
6,612,077 B2 * 9/2003 Parshad ..... 52/36.5
6,735,908 B2 * 5/2004 Edwards ..... 52/36.1
7,051,482 B2 * 5/2006 MacDonald et al. ..... 52/239
7,461,484 B2 * 12/2008 Battey et al. ..... 52/220.7
7,661,237 B2 * 2/2010 Jakob-Bamberg et al. ..... 52/506.08
7,735,939 B2 6/2010 Parshad et al.

(Continued)

*Primary Examiner* — Robert Canfield
*Assistant Examiner* — Brent W Herring
(74) *Attorney, Agent, or Firm* — Riches, McKenzie & Herbert LLP

(57) ABSTRACT

A modular office partition that can be joined together to form dividing wall structures in which the partition has a skeleton frame with opposed faces covered by a plurality of covers with each cover being removably coupled to the frame in either a remote position or in a proximate position such that the partition will have a first width when the covers are connected to the frame in the proximate position and a second width greater than the first width when the covers are connected to the frame in the remote position. Preferably, the covers are removably mounted to the frame via cover retaining clips with the clips being removable from the frame and the clips being provided as wider and narrower clips so as to mount each cover in either the remote position or the proximate position.

15 Claims, 30 Drawing Sheets

(56) References Cited

U.S. PATENT DOCUMENTS

| | | | | |
|---|---|---|---|---|
| 7,902,457 | B2 * | 3/2011 | Johnson | 174/61 |
| 7,908,805 | B2 * | 3/2011 | Metcalf et al. | 52/239 |
| 7,975,445 | B2 | 7/2011 | Parshad et al. | |
| 8,006,440 | B2 * | 8/2011 | Thomas et al. | 52/29 |
| 8,042,776 | B2 * | 10/2011 | Johnson | 248/200.1 |
| 8,196,365 | B2 | 6/2012 | Parshad | |
| 2004/0211127 | A1 * | 10/2004 | Wiechecki et al. | 52/36.1 |
| 2008/0168734 | A1 * | 7/2008 | Degen et al. | 52/520 |

* cited by examiner

VARIABLE WIDTH MODULE OFFICE FURNITURE PARTITION

SCOPE OF THE INVENTION

This invention relates to modular office partitions which can be joined together to form dividing wall structures and, more particularly, to office partitions in which the same modular frame may be used to provide partitions having different widths.

BACKGROUND OF THE INVENTION

Modular office partitions are well known as being modular partitions which can be joined together to form dividing wall structures as in an office environment. Office partitions are known which have removable covers and have capability for passage of wiring including data cables and electrical wiring internally therethrough. It is known to be advantageous to provide office partitioning systems which include compatible and connectable partitions having different widths as to provide for a pleasing appearance and to provide different capabilities for passage of wiring, structural support and the coupling of accessories.

The present inventors have appreciated the disadvantage that presently known partitions which have different widths are constructed with different internal frame structures.

SUMMARY OF THE INVENTION

To at least partially overcome this disadvantage of previously known partitions, the present invention provides a partition having a skeleton frame with opposed faces covered by a plurality of covers with each cover being removably coupled to the frame in either a remote position or in a proximate position such that the partition will have a first width when the covers are connected to the frame in the proximate position and a second width greater than the first width when the covers are connected to the frame in the remote position. Preferably, the covers are removably mounted to the frame via cover retaining clips with the clips being removable from the frame and the clips being provided as wider and narrower clips so as to mount each cover in either the remote position or the proximate position.

An object of the present invention is to provide a construction for a partition which utilizes a common central frame upon which covers can be removably mounted in different positions from the frame so as to provide resultant partitions with different widths.

Another object is to provide a novel rail as a frame member for use in a frame of a partition.

Accordingly, in one aspect, the present invention provides a freestanding, portable variable width partition for open offices spaces, comprising:

a skeleton frame having two opposite faces, a foot portion adapted to abuttingly support said partition on a floor surface, and orthogonally related top, bottom and two end edges, at least one of said two end edges being shaped for direct connection with a corresponding end edge on an adjacent partition to create a substantially freestanding utility panel system;

said skeleton frame including spaced apart, parallel vertical frame members and spaced apart, parallel horizontal frame members that extend generally orthogonally to said vertical frame members, said vertical frame members being rigidly secured to at least one of the horizontal frame members, and said horizontal frame members being rigidly secured to at least one of the vertical frame members, a plurality of covers, each cover shaped to cover at least a portion of one of the faces of said skeleton frame, each cover being detachably connected with said skeleton frame to provide ready access to an interior portion of said partition, said two opposite faces of the skeleton frame comprise a front face and a rear face, the covers comprises at least one front cover to cover the front face and at least one rear cover to cover the rear face, each cover is detachably connected to frame in one of two positions, a first proximate position and a second remote position, in both the first proximate position and the second remote position each cover covers the same respective portion of one of the faces, each front cover in the remote position is spaced forwardly from the frame a greater extent than when the front cover is in the proximate position, each rear cover in the remote position is spaced rearwardly from the frame a greater extent than when the rear cover is in the proximate position, the at least one front cover having a forwardly directed surface forming a front face of the partition when the front cover is connected to the frame in the proximate position and the remote position, the at least one rear cover having a rearwardly directed surface forming a rear face of the partition when the rear cover is connected to the frame in the proximate position and the remote position, the partition having a width from the front face of the partition to the rear face of the partition, wherein with the each said front cover and each said rear cover connected to the frame in the proximate position the width of the frame is a first width, and with the each said front cover and each said rear cover connected to the frame in the remote position the width of the frame is a second width greater than the first width.

BRIEF DESCRIPTION OF THE DRAWINGS

Further aspects and advantages of the present invention will become apparent from the following description taken together with the accompanying drawings in which.

DETAILED DESCRIPTION OF THE DRAWINGS

Figure 1:
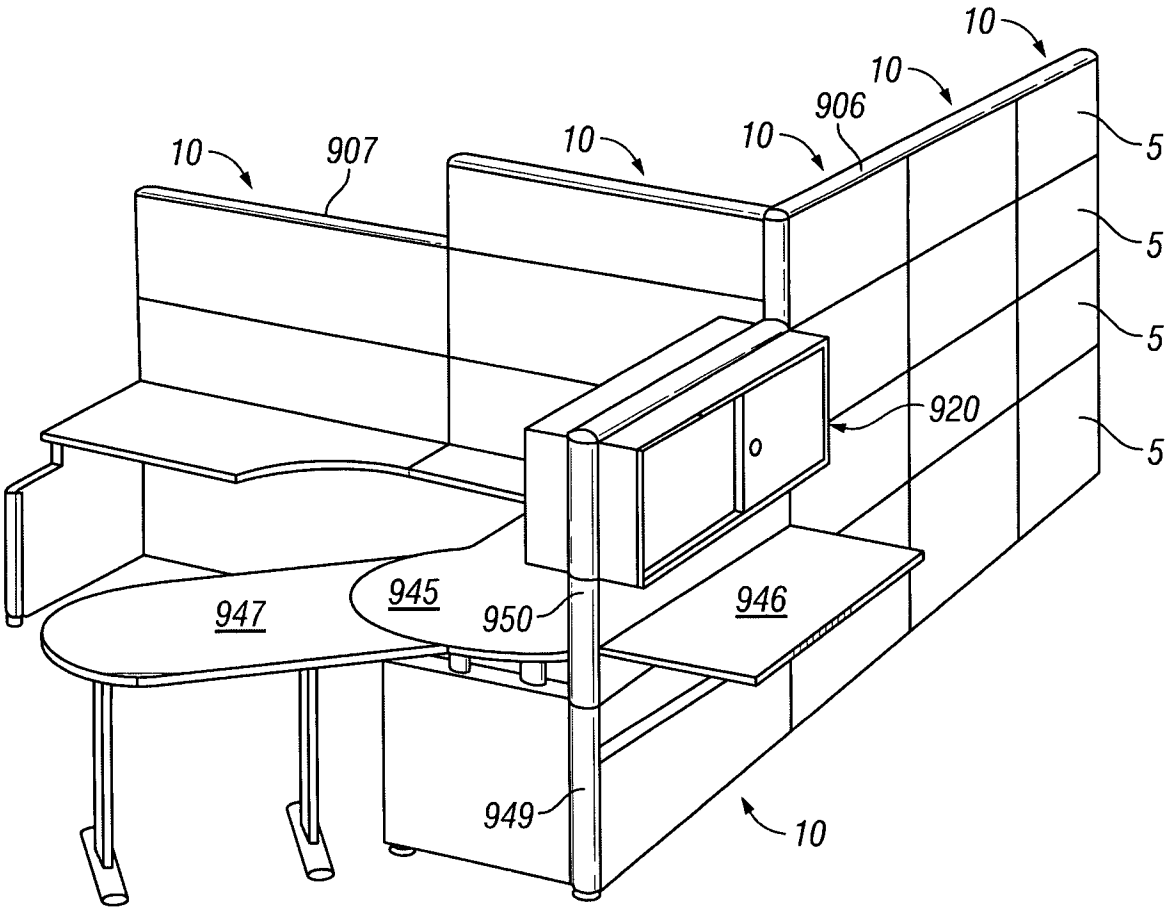
FIG. 1 is a pictorial view of an assembled modular office furniture system utilizing partitions in accordance with the present invention.

Reference is made to FIG. 1 which shows a modular office furniture system utilizing a plurality of partitions 10 to divide an office space and, for example, to provide support for various structures including desks 945, 946 and 947 and an overhead storage bin 920.

Figure 2:
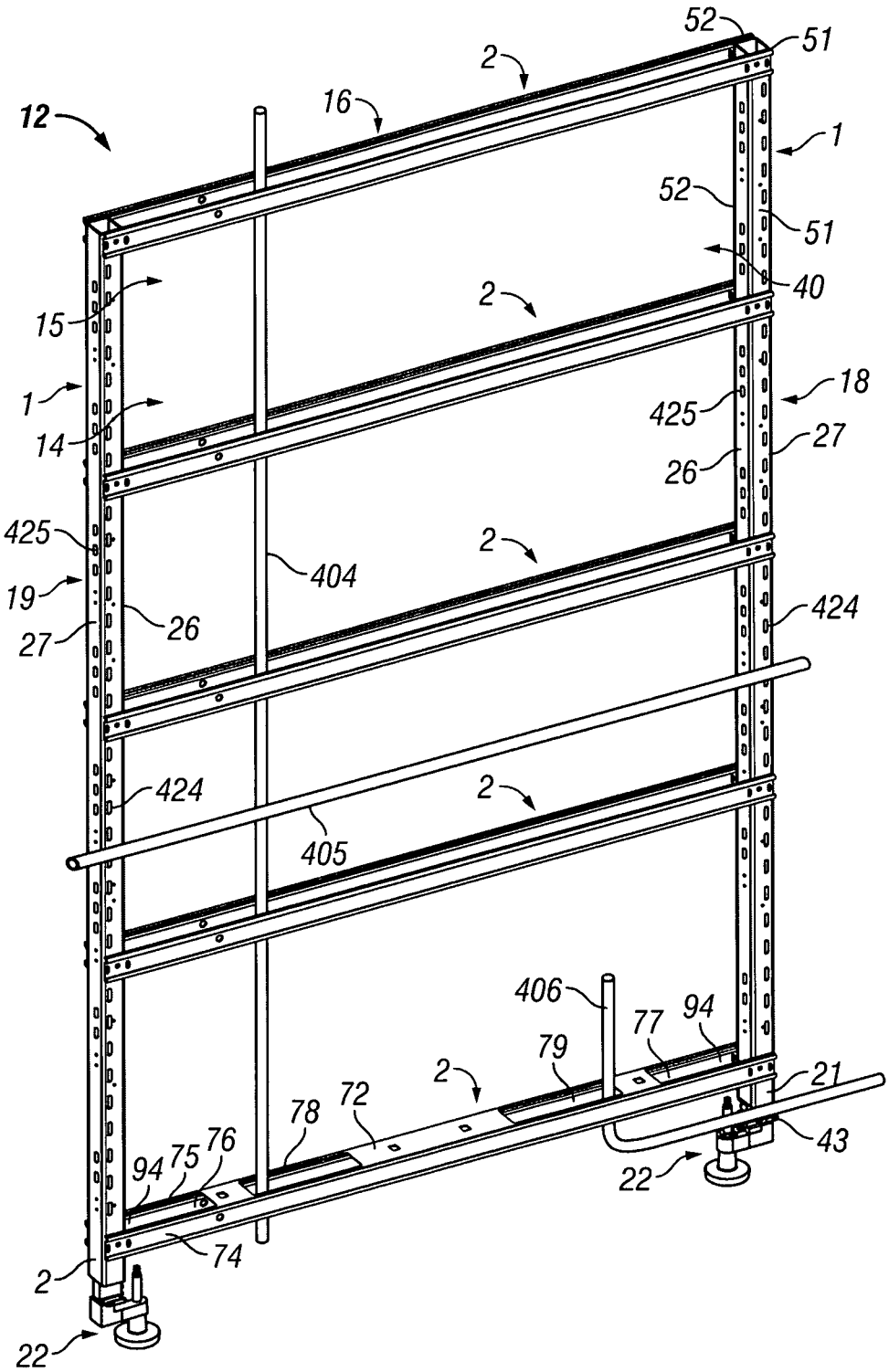
FIG. 2 is a front perspective view of the frame of one partition of the type shown in FIG. 1.
Figure 3:
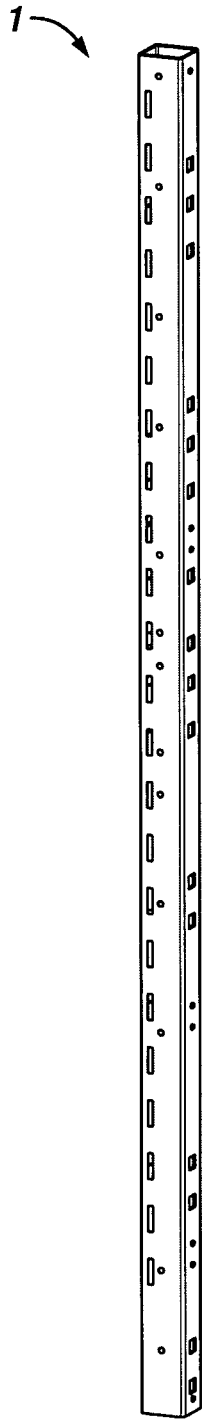
FIG. 3 is a front perspective view of a post of the frame shown in FIG. 2.
Figure 4:
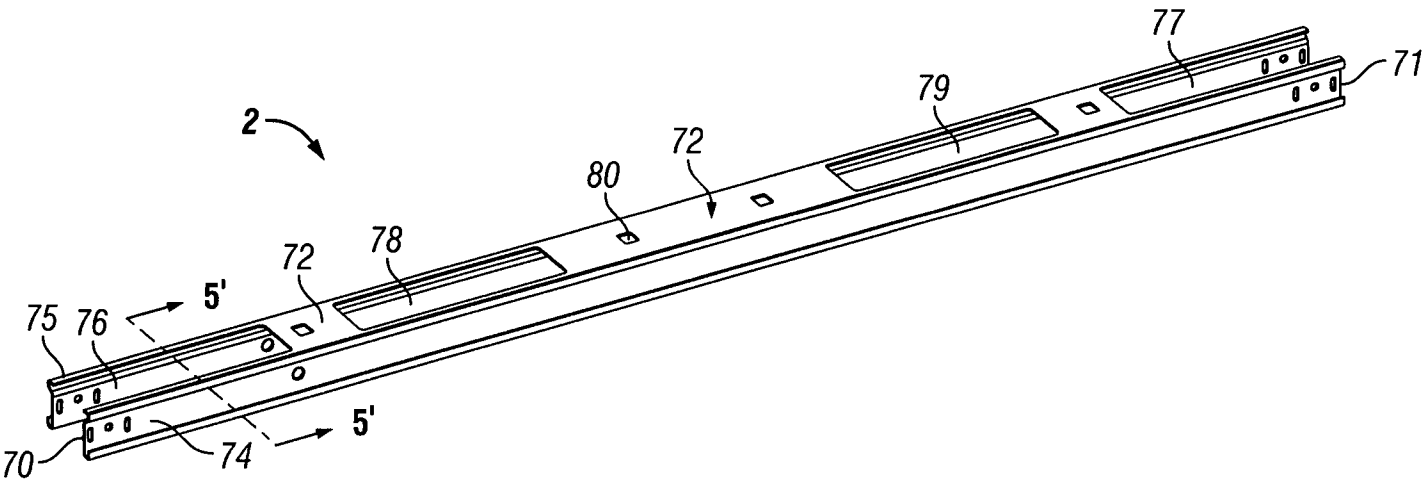
FIG. 4 is a front perspective view of a rail of the frame of FIG. 2.
Figure 6:
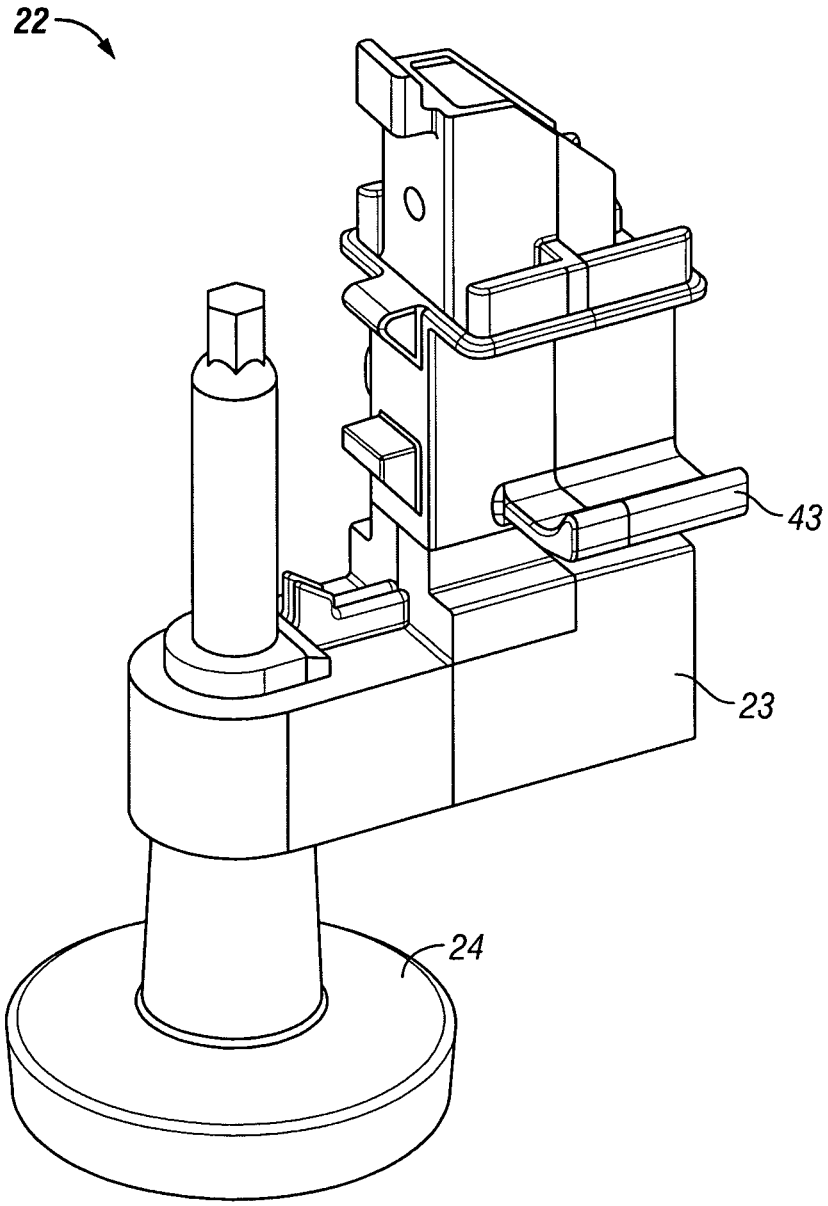
FIG. 6 is a perspective view of a leg assembly of the partition shown in FIG. 2.

Reference is made to FIG. 2 which shows a first embodiment of a frame 12 for one of the partitions 10 shown in FIG. 1. The frame 12 includes vertical frame members or posts 1 and horizontal frame members or rails 2. The posts 1 and rails 2 are rigidly connected together to form the frame with each end of each rail 2 connected to one of the posts 1. The frame 12 forms a skeleton frame having two opposite faces indicated as a front face 14 and a rear face 15. The frame 12 is to be considered to be rectangular having a top edge 16, a bottom edge 17, a first end edge 18 and a second end edge 19 with the edges orthogonally related. The two end edges 18 and 19 are shaped and adapted for direct connection with the corresponding end edge of a similar frame 12 on an adjacent partition 10 as seen in FIG. 1 to create a substantially free standing utility panel system. The posts 1 comprise parallel vertical frame members which are spaced apart. The rails 2 comprise identical horizontal frame members that extend orthogonally to the posts 1. The rails 2 are U-shaped in cross-section with the U shape of a lowermost rail 2 directed downwardly and the U shape of the other rails directed upwardly. Proximate the bottom edge 17, the frame 12 has foot portions 20 and 21 comprising the lowermost end of the posts 1 which are adapted to abuttingly support the frame 12 on a floor surface. Leg assemblies 22 as shown in FIG. 6 are adapted to be secured to the foot portions 20 and 21 of each of the posts 1 to support the frame on a floor surface. As seen in FIG. 6, the leg assembly 22 includes an L-shaped support member 23 upon which a foot 24 is threadably mounted such that rotation of the foot 24 provides for adjustment of height of each post 1.

Figure 7:
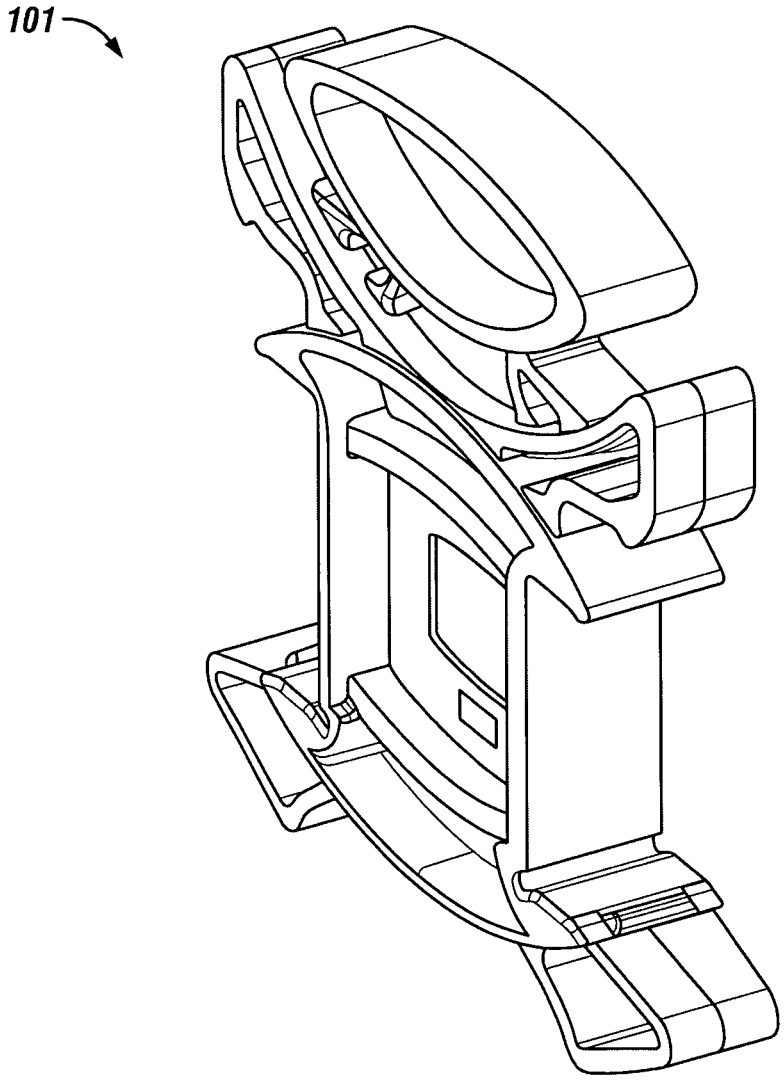
FIG. 7 is a front perspective view of a cover retaining intermediate wide clip.
Figure 8:
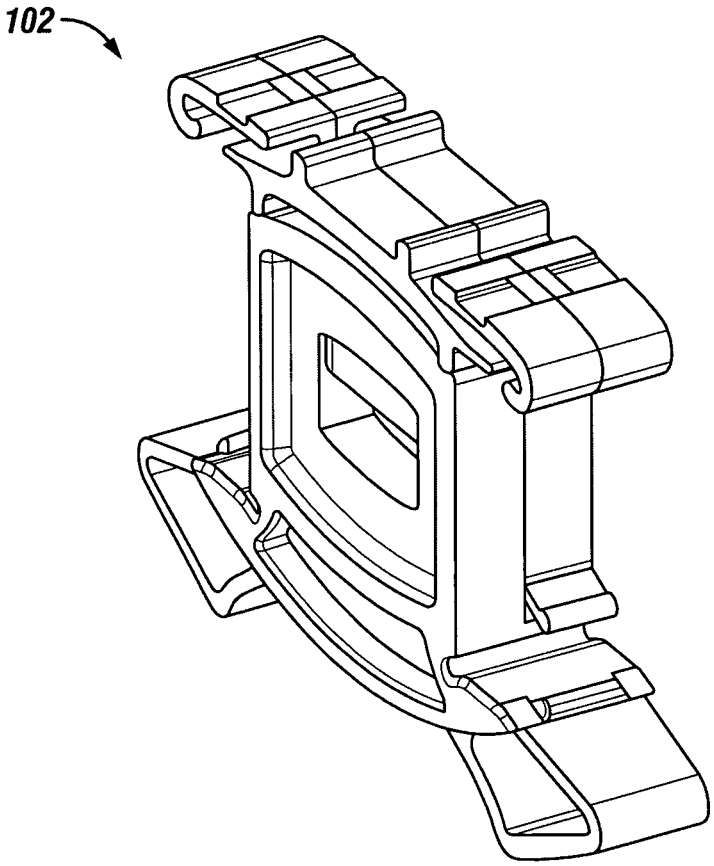
FIG. 8 is a front perspective view of a cover retaining top wide clip.
Figure 9:
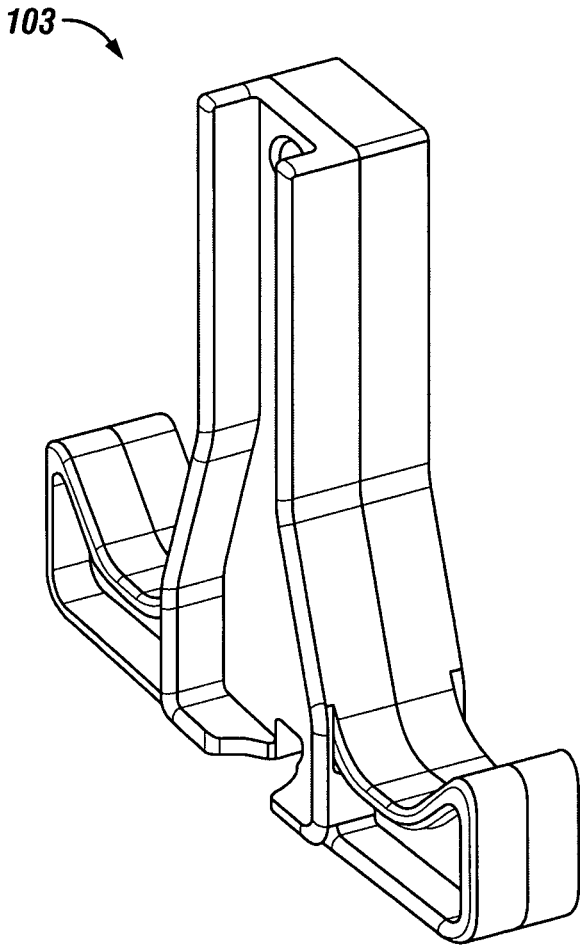
FIG. 9 is a front perspective view of a cover retaining bottom wide clip.
Figure 11:
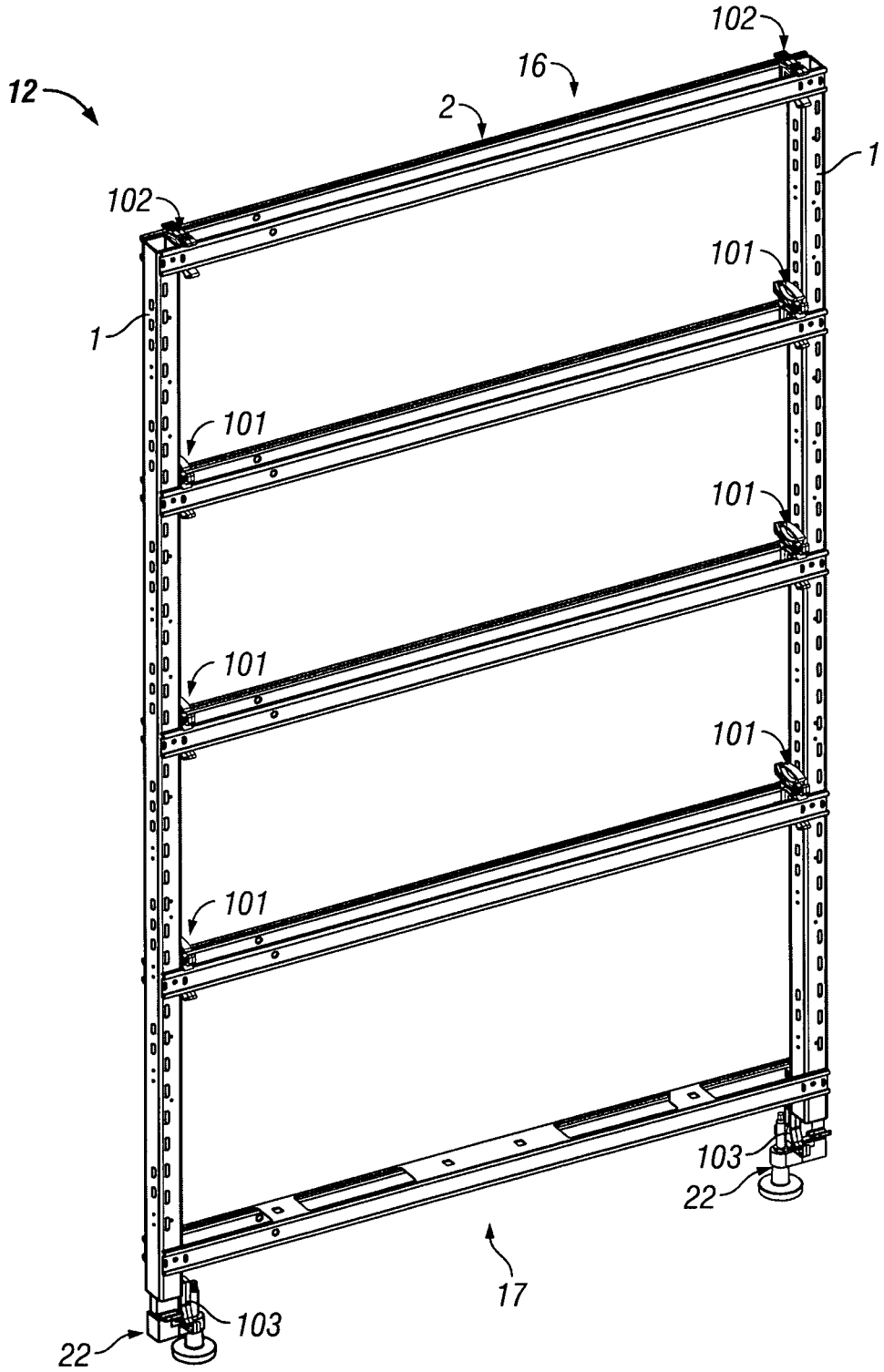
FIG. 11 is a front perspective view of the frame of FIG. 2 with wide clips as shown in FIGS. 7, 8 and 9 secured thereto.

Reference is made to FIGS. 7, 8 and 9 which illustrate cover retaining wide clips adapted to be secured to the frame 12 of FIG. 2 in a manner as shown in FIG. 11. The wide clips comprise, as seen in FIG. 7, a cover retaining intermediate wide clip 101, as seen in FIG. 8, a cover retaining top wide clip 102 and, as seen in FIG. 9, a cover retaining bottom wide clip 103. As seen in FIG. 11, each of the wide clips is secured to the frame 12 adjacent an inside surface 26 of each post 1. A pair of top wide clips 102 are secured to an uppermost of the rails 2 proximate the top edge 16. A pair of the bottom wide clips 103 are secured to the leg assemblies 22 proximate a bottom-most rail at the bottom edge 17. A pair of intermediate wide clips 101 are provided on each of the rails 2 intermediate the uppermost rail and the bottom rail.

Figure 12:
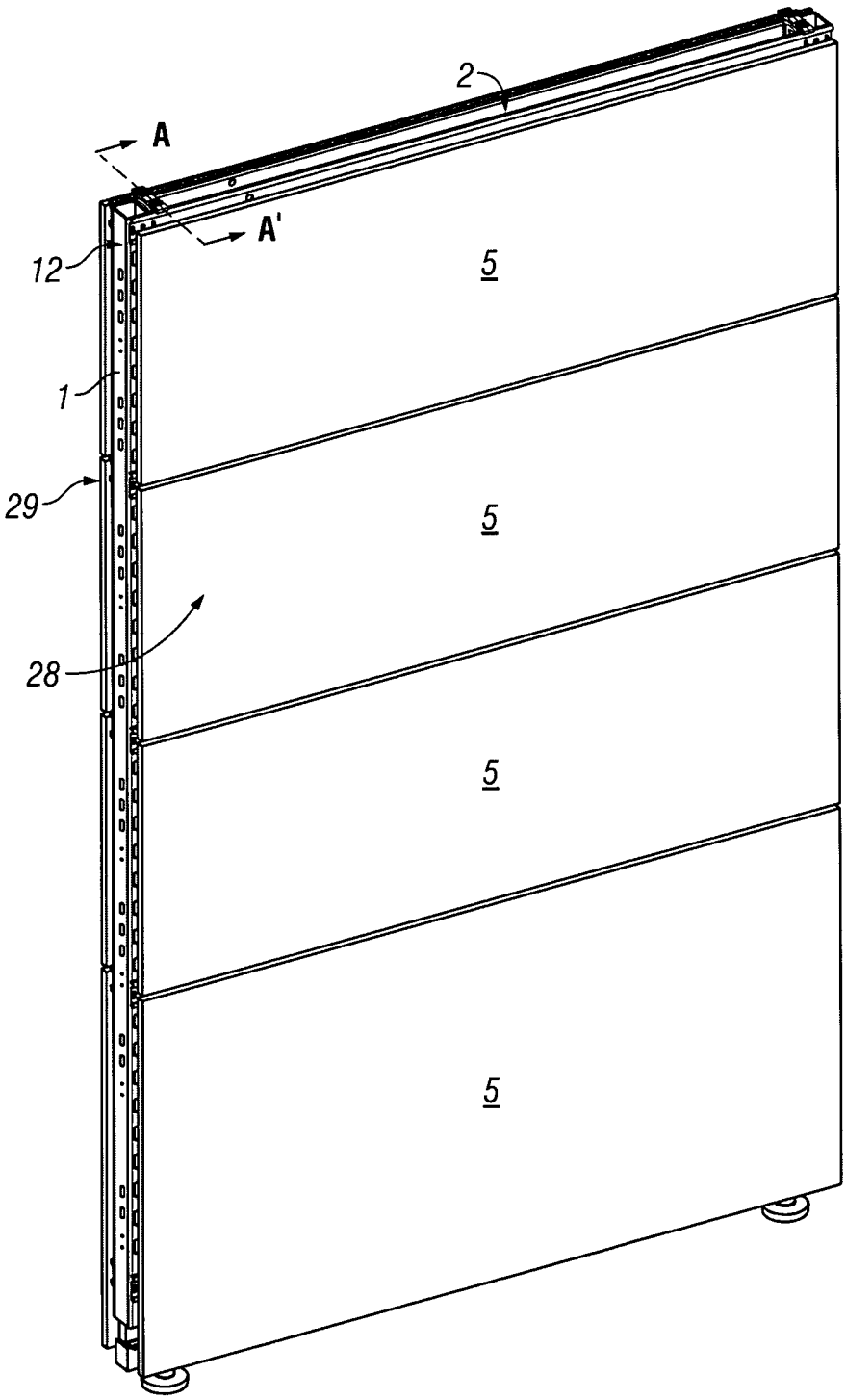
FIG. 12 is a front perspective view of the frame of FIG. 11 with covers secured to the frame by the wide clips.
Figure 13:
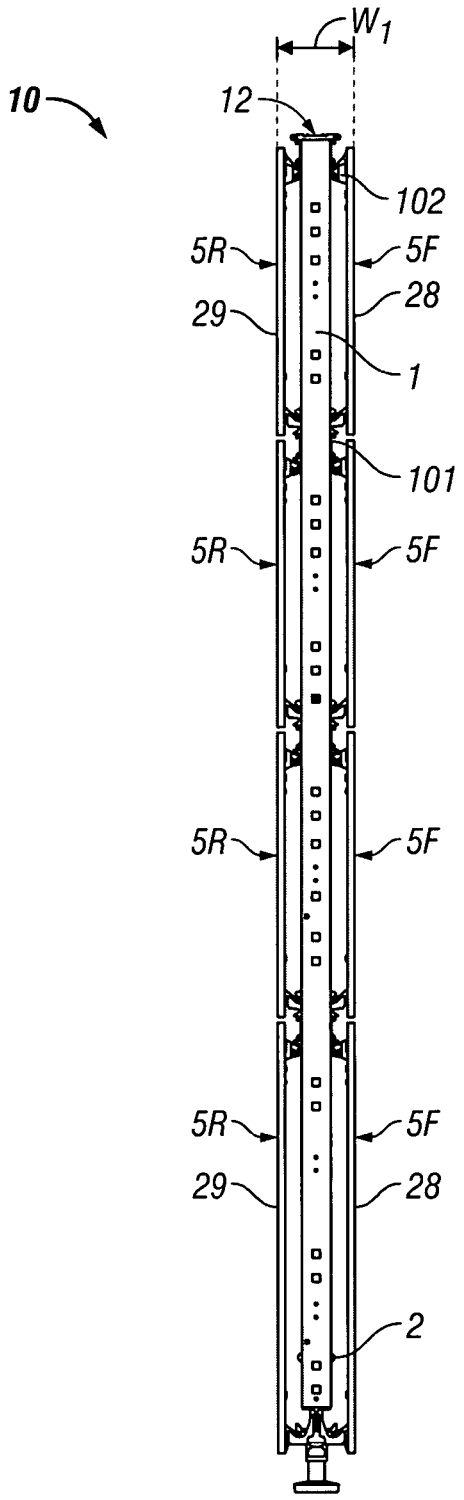
FIG. 13 is an end view of the frame shown in FIG. 12.

As seen in FIG. 12, a plurality of cladding covers 5 are removably coupled to the frame 12 outwardly of the rails 2 by engagement between each cover 5 and respective of the wide clips 101, 102 and 103. Each cover 5 is shaped to cover at least a portion of one of the faces of the frame 12. Each cover 5 is detachably connected with the frame by means of the clips to provide ready access to the frame and thus to interior portions of the partition 10. As seen in FIG. 12, the covers are provided to cover the front face 14 of the frame 12 and, as well, to cover the rear face 15 of the frame. Each cover 5 is either a front cover 5F or a rear cover 5R. In some locations in the Figures, reference 5F is used to identify a cover 5 that is a front cover which covers the front face 14 of the frame and forms a front face of the partition 10 when the front cover 5F is connected to the frame 12. In some locations in the Figures, reference 5R is used to identify a cover that is a rear cover that covers the rear face of the frame and forms a front face of the partition when the rear cover 5R is connected to the frame. Each front cover 5F has a forwardly directed surface 28 which forms the front face of the partition. Each rear cover 5R has a rearwardly directed surface 29 forming a rear face of the partition 10 when the rear cover 5R is connected to the frame 12. FIG. 13 shows an end view of the wide partition shown in FIG. 12. The wide partition 10 is shown as having a width W1 from the front face 28 of the partition to the rear face 29 of the partition.

Figure 14:
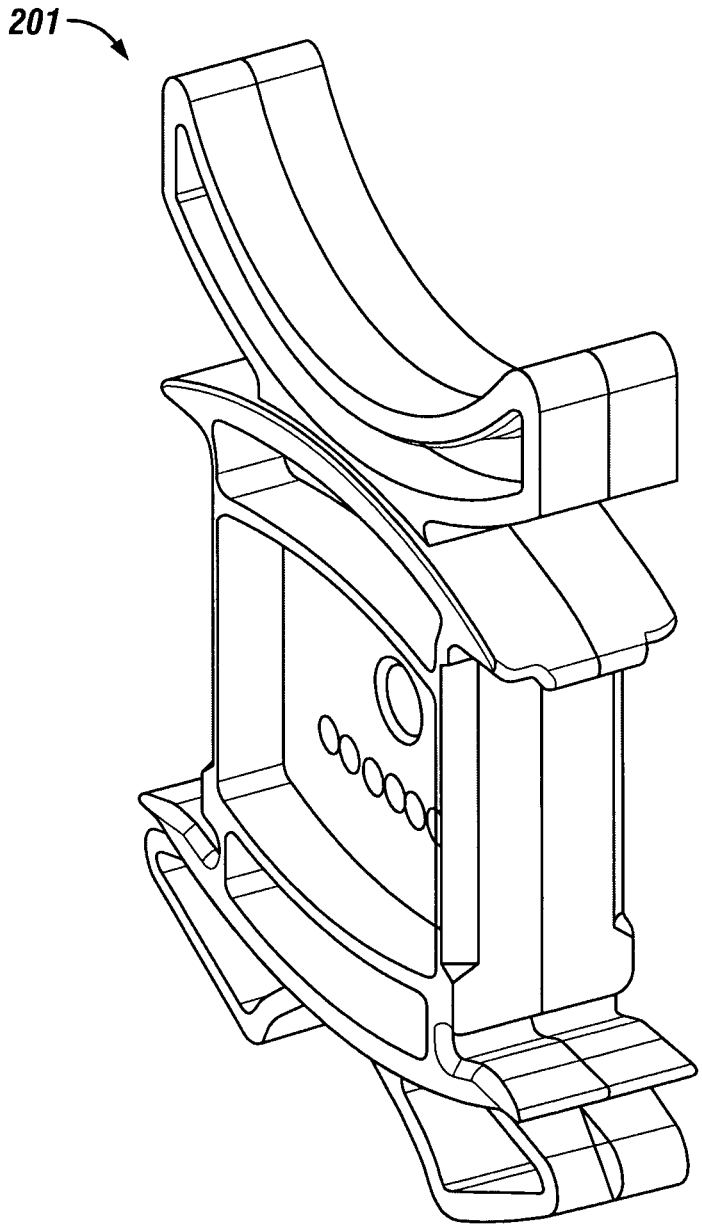
FIG. 14 is a front perspective view of a cover retaining intermediate narrow clip.
Figure 15:
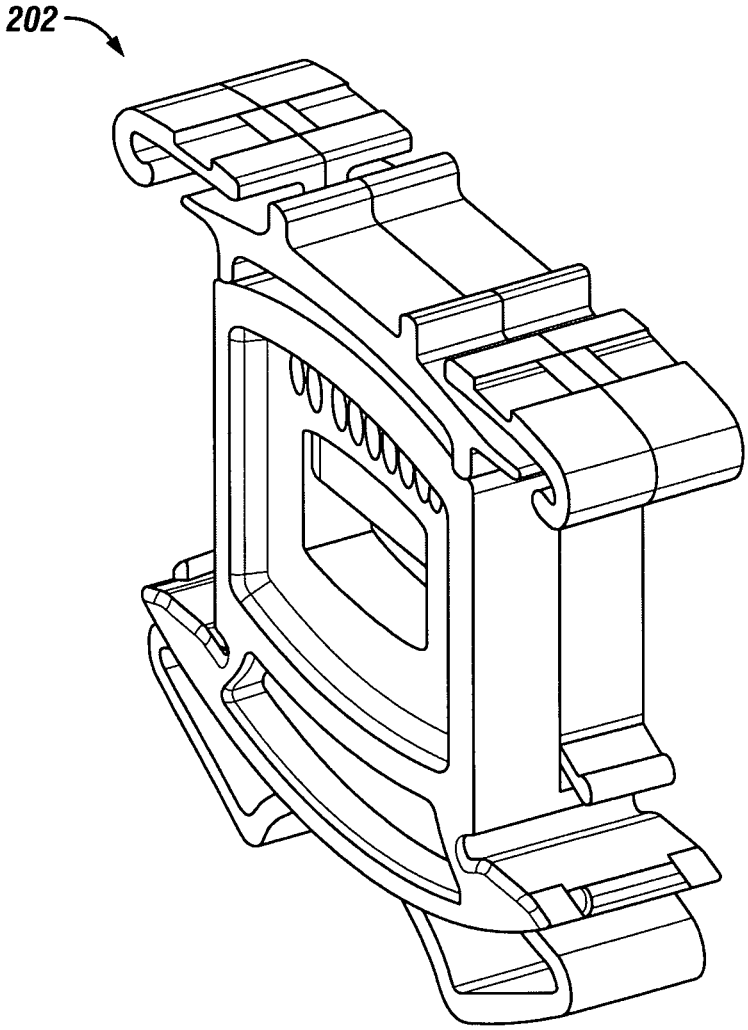
FIG. 15 is a front perspective view of a cover retaining top narrow clip.
Figure 16:
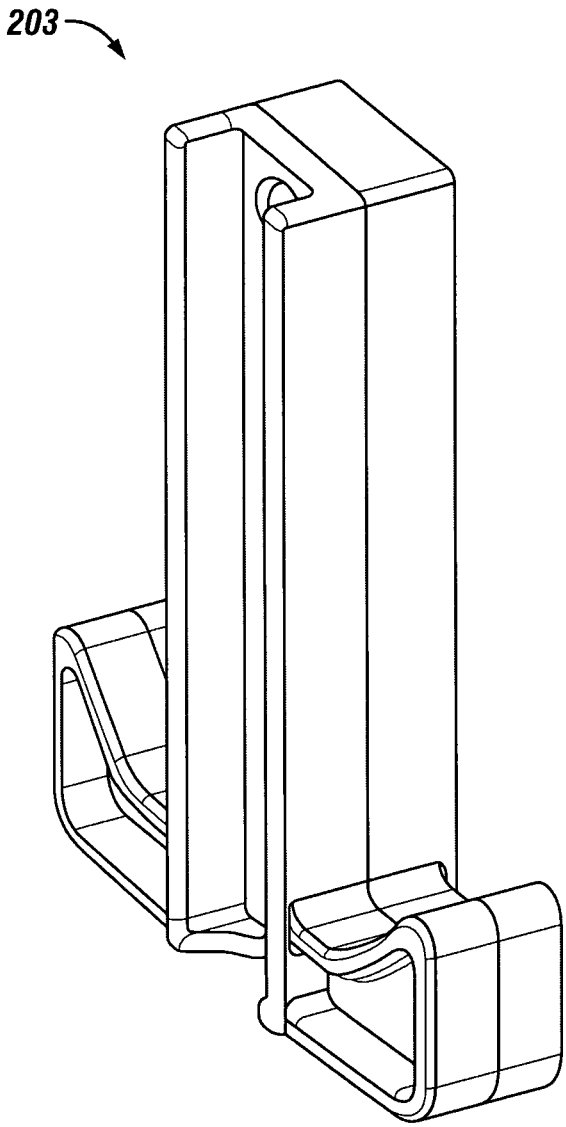
FIG. 16 is a front perspective view of a cover retaining bottom narrow clip.
Figure 17:
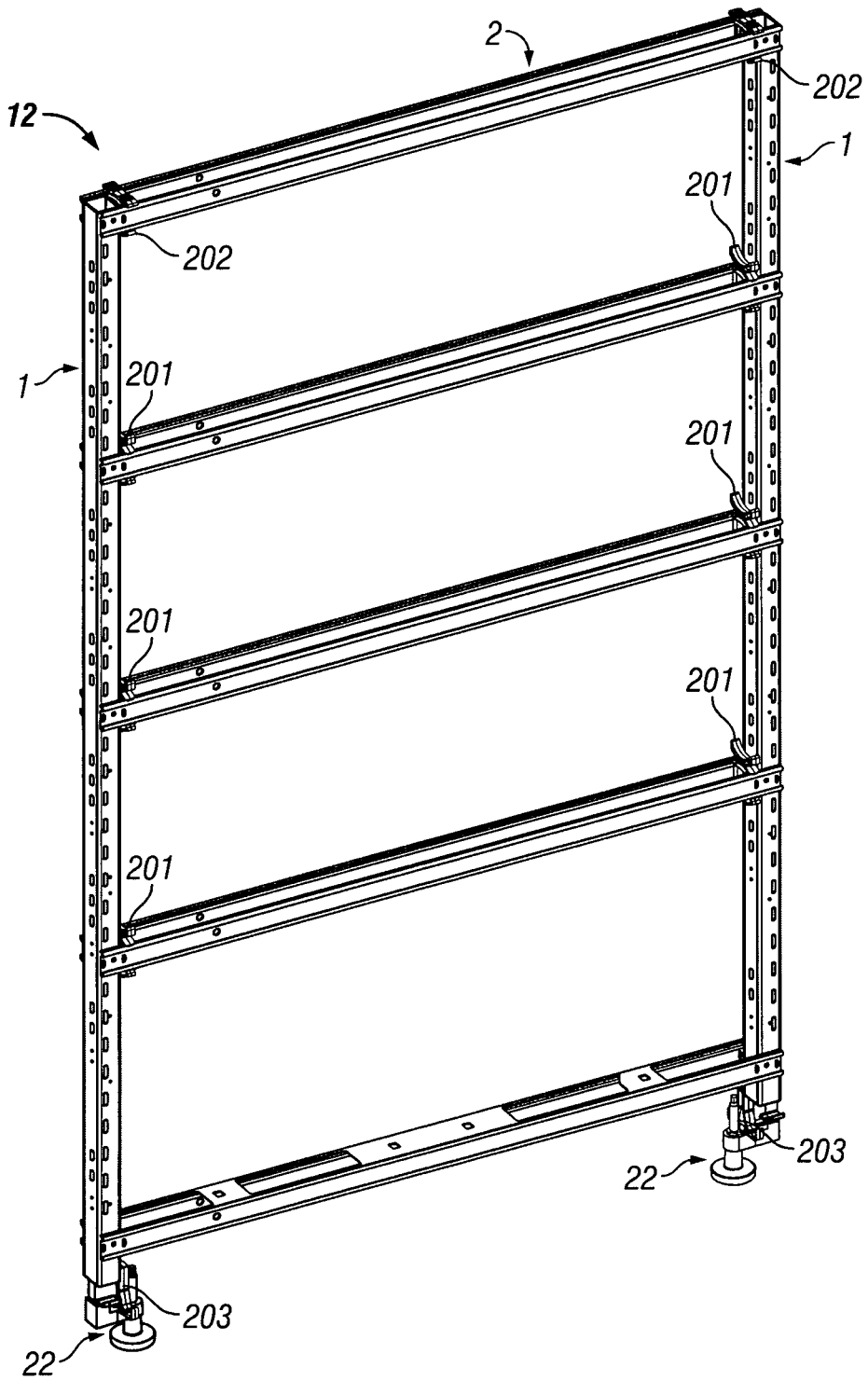
FIG. 17 is a front perspective view of the frame of FIG. 2 with narrow clips as shown in FIGS. 14, 15 and 16 secured thereto.
Figure 18:
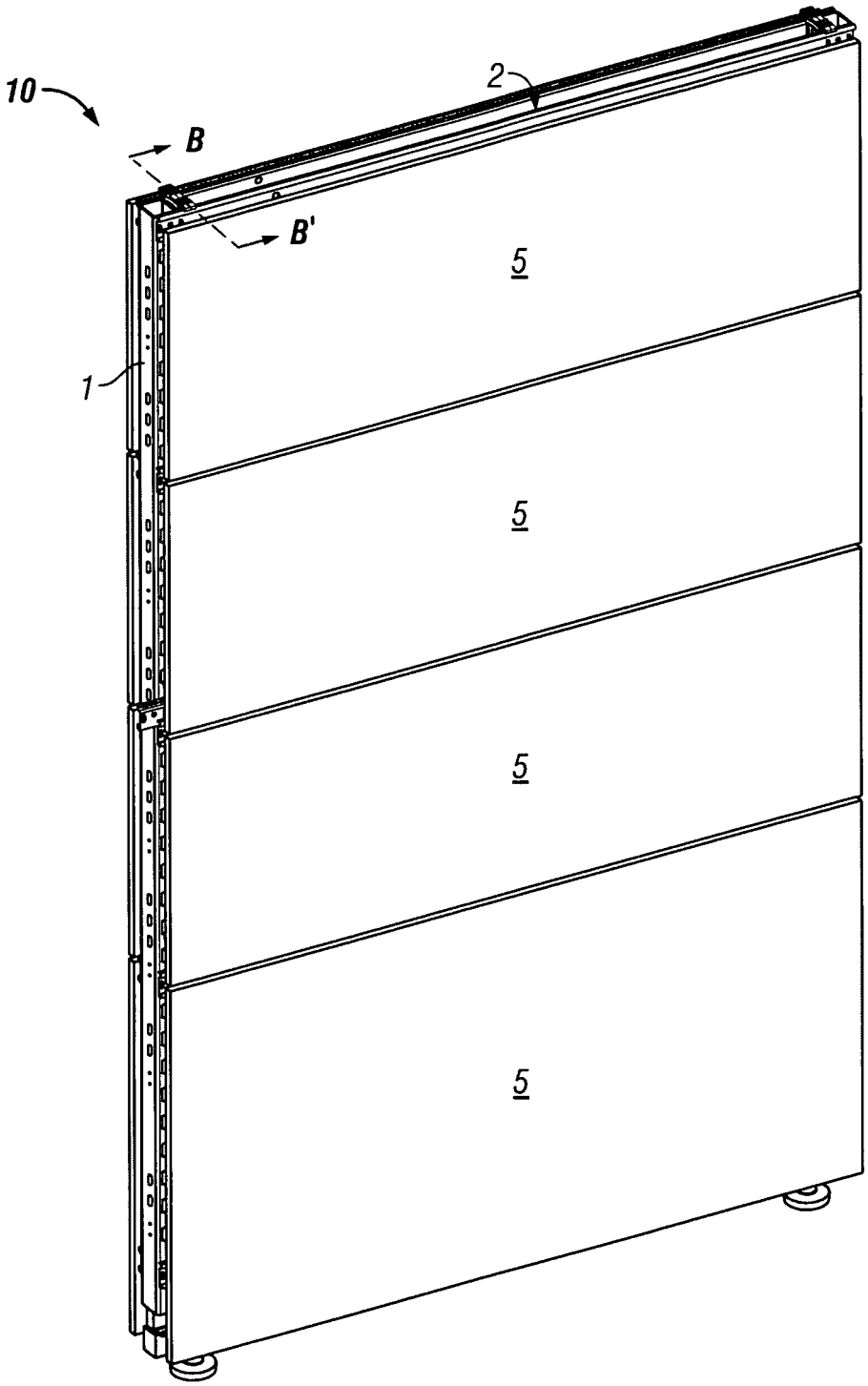
FIG. 18 is a front perspective view of the frame of FIG. 17 with covers secured to the frame by the narrow clips.
Figure 19:
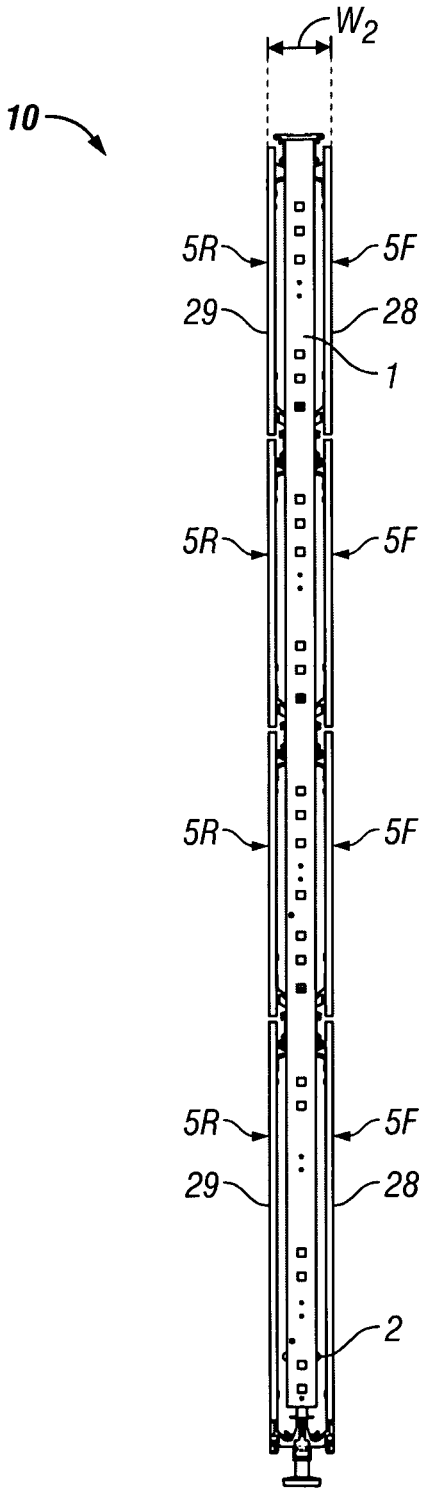
FIG. 19 is an end view of the frame shown in FIG. 18.

Reference is made to FIGS. 14, 15 and 16 which show a second set of cover retaining clips which are narrow clips and are adapted to be substituted for the wide clips illustrated in FIGS. 7 to 13. FIG. 14 shows a cover retaining intermediate narrow clip 201. FIG. 15 shows a cover retaining top narrow clip 202. FIG. 13 shows a cover retaining bottom narrow clip 203. FIG. 17 shows the frame of FIG. 2 with the narrow clips 201, 202 and 203 coupled thereto in an analogous manner to that in which the wide clips 101, 102 and 103 are shown as coupled to the frame in FIG. 11. FIG. 18 shows the same covers 5 as illustrated in FIG. 12 applied to the frame as shown in FIG. 17 by connection with the narrow clips 201, 202 and 203. FIG. 19 is an end view of the frame shown in FIG. 18 and showing a narrow partition having a width W2 between the front face 28 of the partition and the rear face 29 of the partition.

Figure 20:
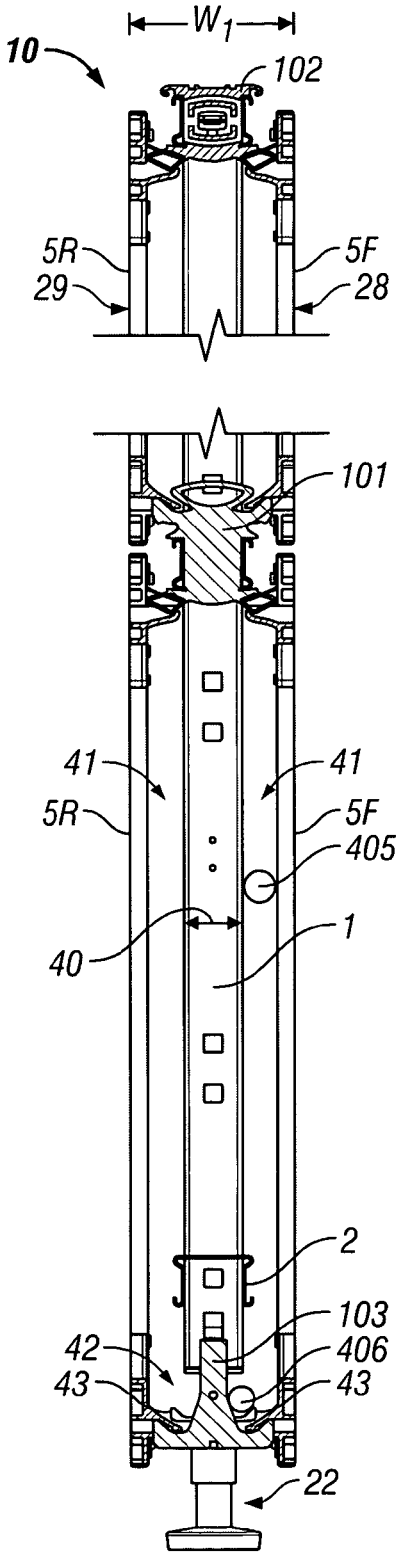
FIG. 20 is a schematic enlarged cross-sectional end view of the wide partition shown in FIG. 12 along section line A-A' in FIG. 12.
Figure 21:
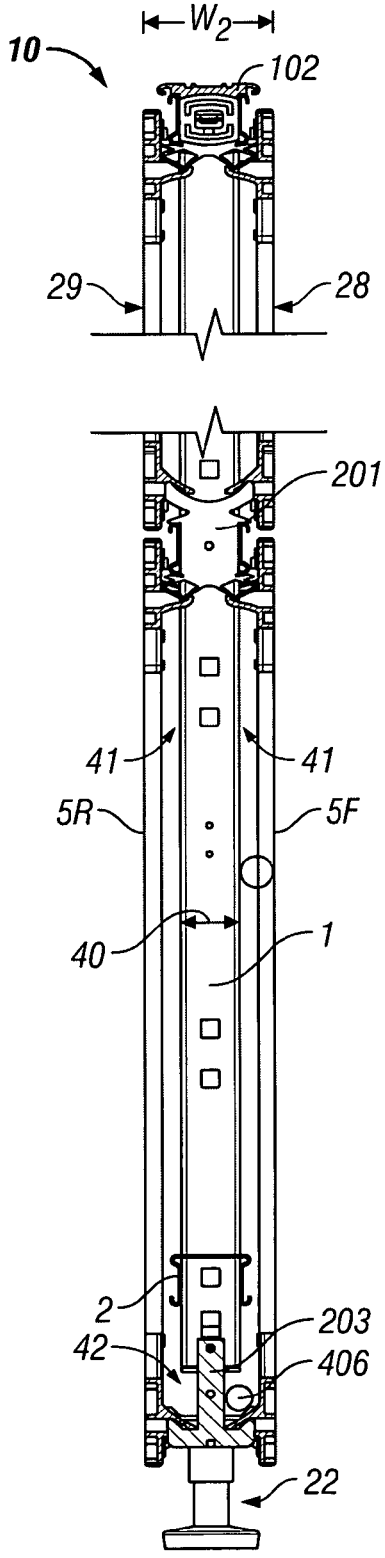
FIG. 21 is a schematic enlarged cross-sectional end view of the narrow partition shown in FIG. 18 along section line B-B' in FIG. 18.

Reference is made to FIGS. 20 and 21 which, for convenience, are located adjacent each other on the same drawing sheet and of the same scale. FIG. 20 is an enlarged cross-sectional end view of the wide partition of FIG. 12 along section line A-A' in FIG. 12. FIG. 21 is a virtually identical end cross-section, however, showing the narrow partition 10 of FIG. 18 in cross-sectional end view along section line B-B'. Each of FIGS. 20 and 21 show each of the representative cover retaining clips in cross-section and provides an easy visual appreciation that the width W1 of the wide partition 10 shown in FIG. 20 is greater than the width W2 of the narrow partition 10 shown in FIG. 21. In the wide partition, as illustrated in FIGS. 12, 13 and 20, each cover 5 is mounted via the wide clips 101, 102 and 103 in what may be considered a remote position. In a narrow partition 10 as illustrated in FIGS. 18, 19 and 21, each cover 5 is mounted via the narrow clips 201, 202 and 203 in what may be considered a proximate position. As seen in FIG. 20, each front cover 5F in a remote position is spaced forwardly from the frame 12 a greater extent than the same front cover 5F is in the narrow partition 10 shown in FIG. 21 in the proximate position is spaced forwardly from the frame 12. Similarly, each cover 5R in the remote position as seen on the wide partition 10 in FIG. 20, is spaced rearwardly from the frame 12 a greater distance than the extent that the same rear cover 5R is spaced rearwardly from the frame 12 when the rear cover 5R is in the proximate position on the narrow partition 10 as shown in FIG. 21. Thus, in FIG. 20 showing the partition 10 in a wide configuration, with each cover 5 mounted in the remote position, the partition has a width W1. In contrast, with the partition 10 in the narrow configuration as shown in FIG. 21, each cover 5 is mounted to the frame 12 in the proximate position and this narrow partition 10 has a width W2. The width W1 of the wide partition of FIG. 20 is greater than the width W2 of the narrow partition of FIG. 21.

Each of the cover mounting clips 101, 102, 103, 201, 202 and 203 are removably coupled to the frame 12. By merely applying either a set of the wide clips 101, 102 and 103 to a frame 12 or a set of narrow clips 201, 202 and 203 to a frame 12, the partition 10 may be provided to either be a wide partition 10 of the width W1 or a narrow partition 10 of the width W2. For both the wide and narrow configurations of the partition 10, the identical same frame 12 and the identical same covers 5 are utilized.

Each posts 1 is preferably a hollow structural square steel tube. The posts 1 include a vertical series slots 424 in their front surface 51 and rear surface 52. The slots 424 are used to adjustably and removably support hanger brackets for suspending various furniture components upon the posts 1 of each partition. The posts 1 also include a vertical series of horizontal openings 425 through the posts 1 from the inner surface 26 to the outer surface 27 as to assist in connection of the posts end-to end.

Figure 5:
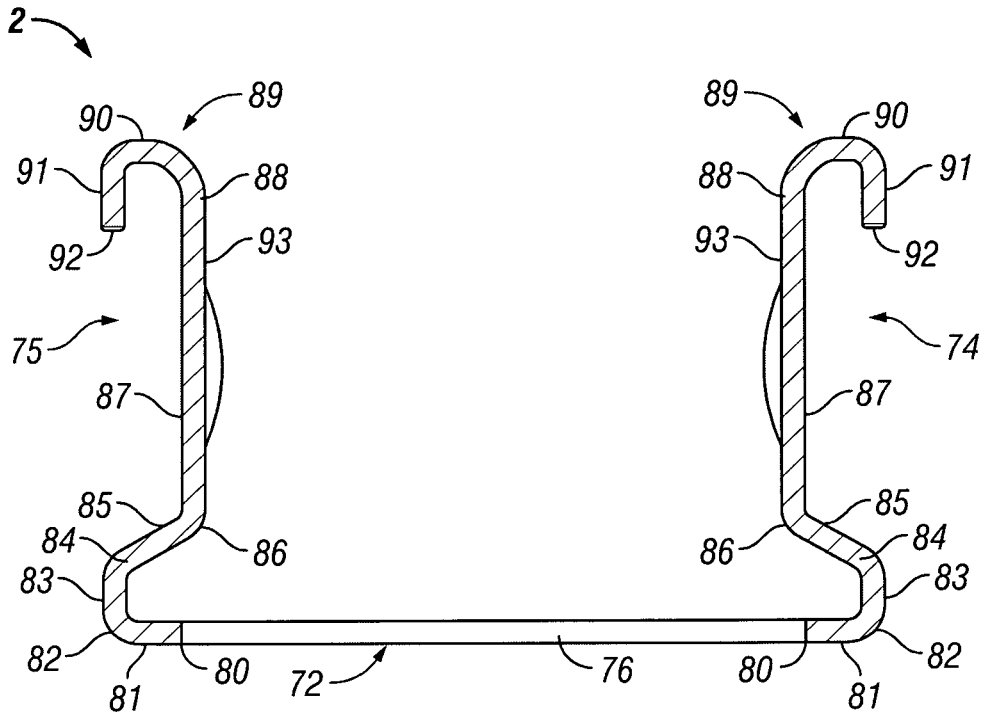
FIG. 5 is a cross-sectional end view of the rail of FIG. 4 along section line 5-5'.

Each rail 2 is shown as having a U-shape as seen in end view in FIG. 5. The rail 2 is preferably formed from a sheet of metal and is preferably formed by bending and/or cold rolling the metal sheet and removing portions of the sheet. The rail is elongate and has a first end 70 and a second end 71. Each rail 2 has three portions namely a central bight or joining web 72, a front beam 74 and rear beam 75.

The web 71 is cut away at each of its ends to provide a first end slot 76 between the front beam 74 and the rear beam 75 at the first end 70 and a second end slot 77 between the front beam 74 and the rear beam 75 at the second end 71. The web 71 is also cut away to provide two major apertures 78 and 79 therethrough through which wiring may pass vertically. Additionally, smaller openings 80 are shown through the web 71 as to assist in securing components such as supports for wiring and electrical outlets and the like within the partition.

The front beam 74 may be characterized as the entire portion of the rail 2 shown cross-hatched in cross-section to the right of the first end slot 76 as seen in FIG. 5 and the rear beam 75 may be characterized as that portion of the rail 2 shown cross-hatched in cross-section to the left of the first end slot 76 as seen in FIG. 5.

The front beam 74 comprises a horizontal first end portion 81 commencing at an inner end 80 merging via a radiused corner 82 into a first outer face portion 83, merging at 84 into an inwardly and upwardly extending bevel portion 85, merging at 86 into a straight inner side wall portion 87, merging at 88 into a curving hook like second end portion 89 with a curved bight 90 and a straight outer leg 91 ending at a second end 92.

The rear beam 76 is a mirror image of the front beam 74 and similarly comprises a horizontal first end portion 81 commencing at an inner end 80 merging via a radiused corner 82 into a first outer face portion 83, merging at 84 into an inwardly and upwardly extending bevel portion 85, merging at 86 into a straight inner side wall portion 87, merging at 88 into a curving hook like second end portion 89 with a curved bight 90 and a straight outer leg 91 ending at a second end 92.

The straight inner side wall portion 87 of each of the front beam member 74 and the rear beam member 75 has a substantially planar inwardly directed surface 93.

As seen in FIG. 2, each post 1 is received within the first end slot 76 or the second end slot 77 of a rail 2 such that the front face 51 of the post 1 is secured in a moment resisting connection, preferably by welding, in engagement with the inwardly directed surface 93 of inner side wall portion 87 of the front beam member 74 and the rear face 52 of the post 1 is secured in a moment resisting connection, preferably by welding, in engagement with the inwardly directed surface 93 of inner side wall portion 87 of the rear beam member 75. The first end slot 76 and the second end slot 77 each extend from the respective end of the rail 2 past the inside surface 26 of their respective post such that, as seen in FIG. 2, an opening 94 remains through the web 72 adjacent each post 1 which can be used as to pass wiring vertically through the rail 2.

These openings 94 also serve as locations along which sections of the front beam 74 and the rear beam 75 are free of the web and the cover securing clips such as clips 101, 102, 201 and 202 may be removably coupled to the beams 74 and 75 against front to rear movement by being located in between the beams 74 and 75 and against up and down movement, with upwardly directed surfaces of each clip engaging downwardly directed surfaces of each beam and downwardly directed surfaces of each clip engaging upwardly directed surfaces of each beam.

The preferred clips 101, 102, 201 and 202 illustrated are adapted to be located in the openings 94 between the beams 74 and 75 as seen in the Figures a friction-fit relation with manual removal or replacement by twisting each clip about a vertical axis 90 degrees.

Each beam 74 and 75 is provided as structure which resists deflection of the beam normal to a longitudinal extending end to end of the beam as in the manner of a closed tube, however, with a configuration which facilitates forming the rail 2 by bending and forming a sheet of material. The preferred beams shown have two partial box structures which extend longitudinally. Firstly, a U-shaped structure which resists deflection is formed by the inner side wall portion 87, the curved bight 90 and the outer leg 91. Secondly, an S-shaped structure which resists deflection is formed by the straight inner side wall portion 87, the bevel portion 85, the first outer face portion 83 and the first end portion 81.

The partition 10 is formed from an open gridwork of posts 1 and rails 2. As a result, the partition has an open interior cavity which advantageously permits the passage of wires and cables. The open interior cavity is made up of central post spaces 40 between the posts 1 together with horizontally extending raceways 41 adjacent and open to the central post space 40. Each central post space 40 is defined between the posts 1, that is between a forward plane including the forward face 51 of each post 1 and a rearward plane including the rearward face 52 of each post 1. Each central post space 40 extends vertically between the spaced, parallel forward and rearward planes and between interior faces 26 of the posts 1. The apertures 78 and 79 and the slots 76 and 77 through the webs 72 of the rails 2 provide for vertical communication between the central post spaces continuously vertically throughout the height of the partition and open upwardly to above the top edge 16 of the frame 12 of the partition and open downwardly to below the bottom edge 17 of the frame 12. A cable 404 is shown in FIG. 2 as extending vertically throughout the height of the frame 12 through the central post spaces 40 and the apertures 79.

A plurality of raceways 41 extends horizontally between the beams 2 outward of respective of the forward or rearward planes. The raceways 41 extend the full width of each partition and are open at each end to beyond the exterior end faces 27 of the posts 1.

The raceways 41 are inward of the covers 5 and preferably extend forwardly and rearwardly from the respective forward or rearward plane at least the thickness of the beams 2.

The raceways 41 are open on their inner sides to the central post space 40 over the entire distance between the posts 1. Whereas the central post space 40 ends at the interior end faces of the posts 1, the raceways 41 provide for a passageway for cables such as a cable 404 in FIG. 2 horizontally past the posts 1 outward of the posts 1 inward of the covers 5. As seen in FIG. 2, a cable 405 is shown to extend through one raceway 41.

The central post space 40 provides a passageway for cables vertically past the beams 2 inward of the beams 2 and inward of the covers 5. With the raceways 41 and each central post space 40 in communication, the cavity permits cables to be passed vertically through the portion between the posts 1 inside the beams 2 and horizontally across a partition and between adjacent partitions in the raceways 41 outside the posts 1, between the beams 2 and inside the covers 5. In the context of FIG. 2, with a plurality of corresponding panels 5 removed, a continuous raceway 41 will extend along the entire width of the partition into which cables may easily be laid and extend into another partition joined end-to end. As seen in FIG. 20 and FIG. 21, the raceway 41 extends between the covers 5 and the posts 1, however, in FIG. 20 the raceway has a width which is greater than the width in FIG. 21. For example, the partition 10 in the wide configuration of FIG. 20 may have a preferred width W1 of about 3.5 inches with each raceway 41 having a width of at least ¾ inch which will accommodate conventional electrical conduit including at least 8 wires. The partition 10 in the narrow configuration of FIG. 21 may have a preferred width W1 of about 2.75 inches with each raceway 41 having a width of at least ⅜ inch which will accommodate conventional electrical conduit including at least four wires. However, as seen in FIGS. 20 and 21, two baseline raceways 42 are provided in the partition to the front and rear of the support member 23 of the leg assembly 22 inside each cover 5. The support member 23 has a width which is significantly less than the width of the post 1 such that each baseline raceway 42 can accommodate larger cabling than the raceways 41. For example, with a partition 10 in the narrow configuration of FIG. 21 having a width of about 2¾ inches and a raceway 41 of about ⅜ inch the baseline raceway 42 may have a width of at least ¾ inch and more preferably 1 inch.

The support member 23 of the leg assembly 22 is shown to have cable support arms 43 extending forwardly and rearwardly therefrom below the baseline raceway 42 upon which cables 406 may be supported. FIG. 2 shows such a cable 406 passing from an end edge of the frame 12 as from an adjacent partition, through the baseline raceway 42 then upwardly through the aperture 79 into the interior of the frame. The cables 405 and 406 are shown in cross-section in each of FIGS. 20 and 21.

As seen in FIG. 1, certain of the partitions 10 are secured together end to end in line. This is accomplished with a first end edge 18 of one frame 12 secured to a second end edge 19 of a second frame 12 with an outside end surface 27 of each post 1 in abutment and the two posts 1 being drawn together as, for example, a threaded bolt or nut or other fastener (not shown). Two of the partitions 10 in FIG. 1 are secured together end to end at 90 degrees to each other.

Figure 22:
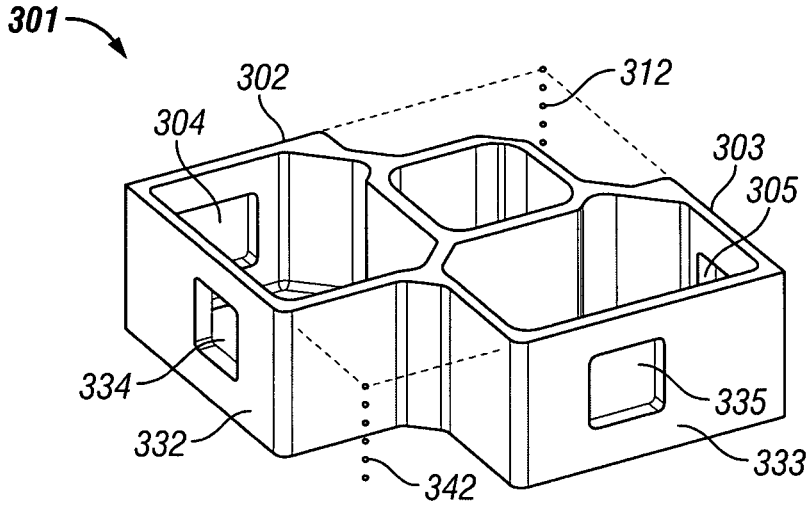
FIG. 22 is a pictorial view of a reversible 90 degree corner connector for connecting partitions of the same width.
Figure 23:
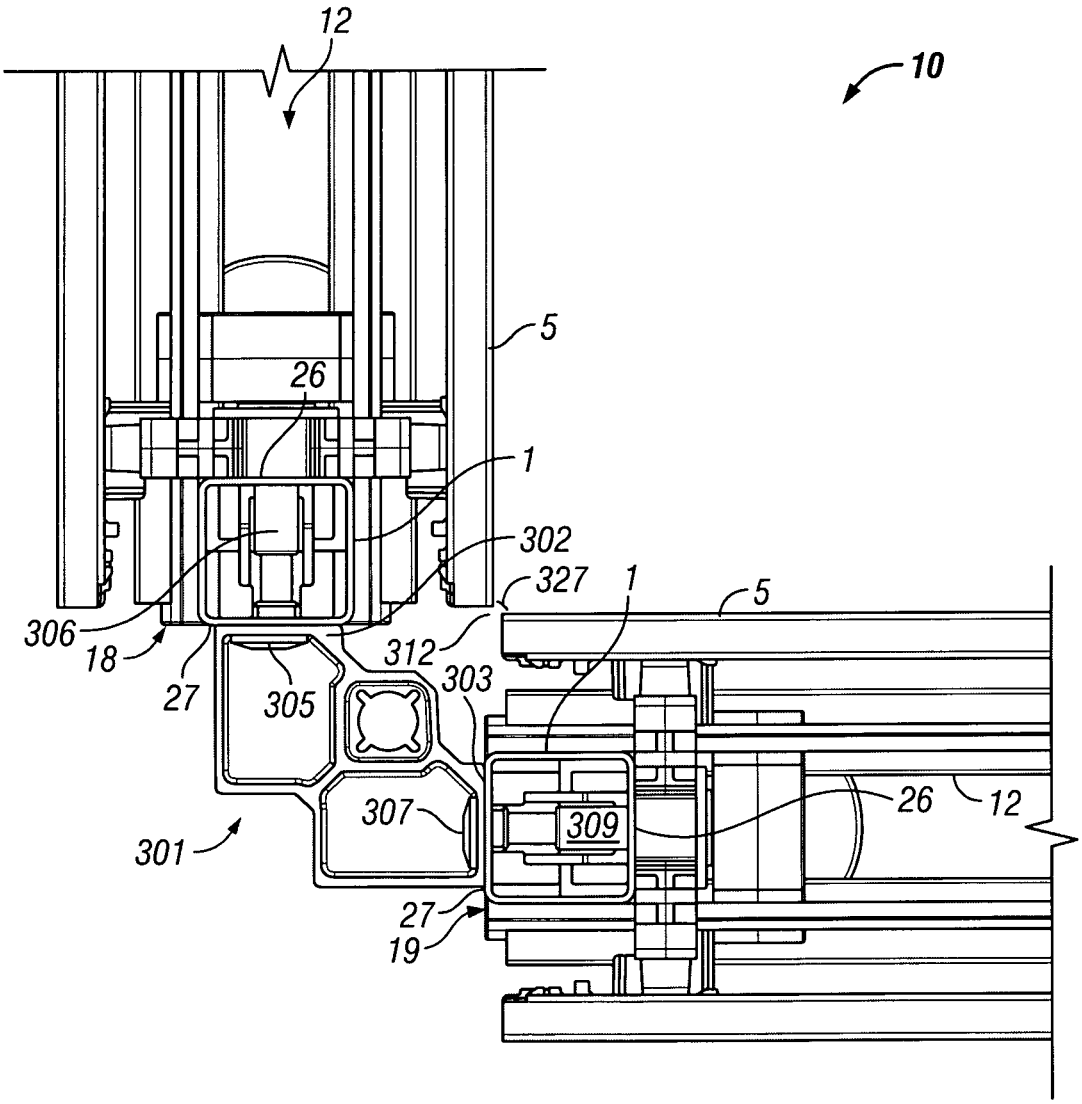
FIG. 23 is a schematic top view showing a reversible corner connector of FIG. 22 connecting two wide partitions.

Reference is made to FIG. 22 which shows a reversible 90 degree width to width corner connector 301 which is adapted for connection of a first end edge 18 of one frame 12 to a second end edge 19 of a second frame 12 with the frames disposed at 90 degrees to each other. FIG. 23 is a top view showing the connector 301 secured to the outside end surface 27 of a post 1 at the first end edge 18 of a frame 12 of a first wide partition 10 and to the outside end surface 27 of a post 1 at the second end edge 19 of the frame 12 of a second wide partition 12. As shown, the planar side surface 302 of the connector 301 is secured by a bolt 305 extending through an opening 304 in the face 302 into a nut 306 which extends inwardly from the inside surface 26 of the post 1. Similarly, the surface 303 of the connector 301 has an aperture 305 and a bolt 307 extends thereto into the post 1 to be engaged in a nut 309 engaging the inside surface 26 of the post. As schematically illustrated in FIG. 22, the faces of the surfaces 302 and 303 intercept at a location indicated by a dotted line 312 also shown in both FIGS. 23 and 24. The distance from the center of the opening 304 to the line 312 and the distance of the center of the opening 305 to line 312 are equal. The line 312, as seen in FIG. 23, is also a line in which an extension of the outside end surfaces 27 of the two posts 1 intersect.

Figure 24:
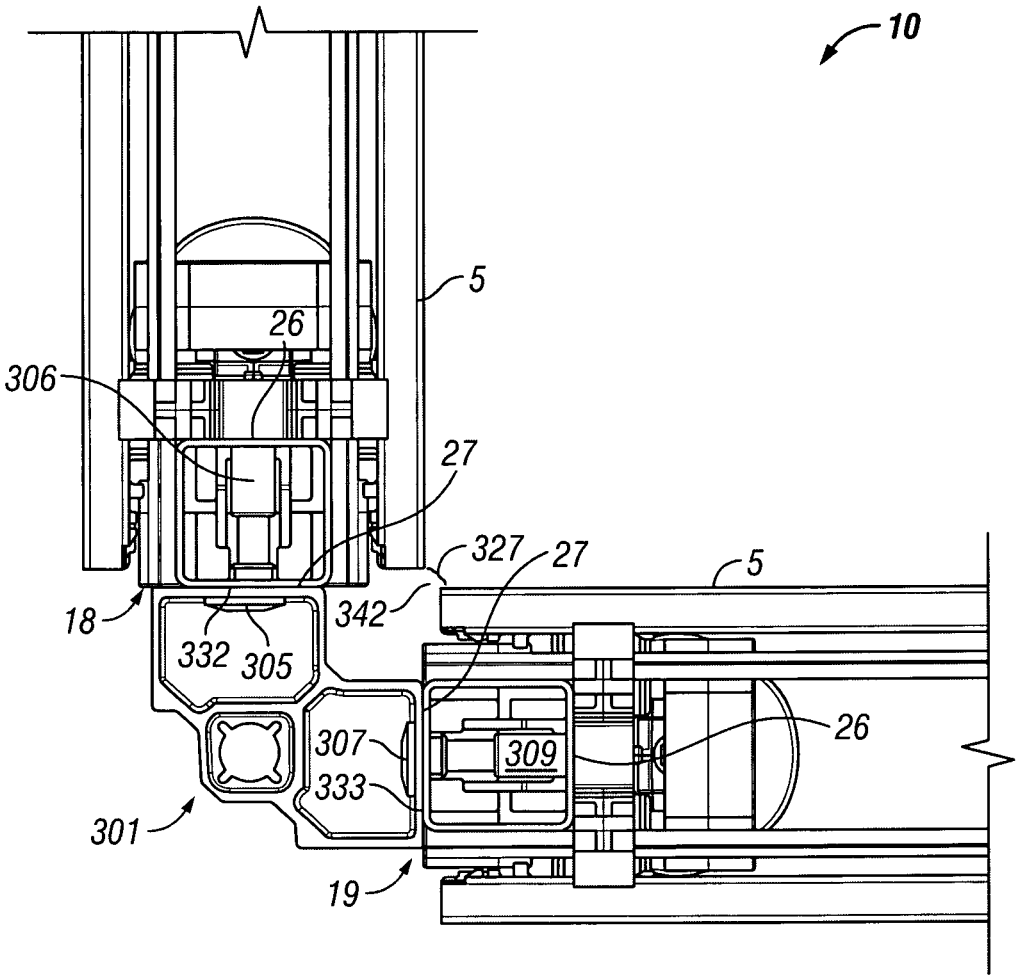
FIG. 24 is a schematic top view showing a reversible corner connector of FIG. 22 connecting two narrow partitions.

Referring to FIG. 24, in FIG. 24, a face 332 of the corner connector 301 is engaged on the surface 27 of the post 1 at the first end edge 18 of the frame 12 of a first of the narrower partitions 10 by the bolt 305 which extends through an opening 334 in the surface 332 and into a nut 306 secured to the post 1. Similarly, the face 333 of the corner connector 301 engages the surface 27 of the post 1 at the second end edge 19 of the frame 12 of a second narrow partition 10 by reason of a bolt 307 extending through an opening 335 in the face 333. An extension of the surface 332 of the connector intersects at a dotted line indicated 342 with an extension of the surface 333. As seen in FIG. 24, this intersection indicated as line 342 is also a point of intersection of the surfaces 27 of the posts 1. Use of the corner connector 301 either in a configuration with a wide partition 10 as shown in FIG. 23 or a narrow partition as seen in FIG. 24 provide for suitable relative location of the partitions 10 so as to provide, for example, an appropriate consistent gap 327 between the inside corners of the covers 5 of the adjacent panels. The provision of the corner connector 301 to be reversible avoids the need for two different separate connectors albeit two different separate connectors could be used.

Figure 25:
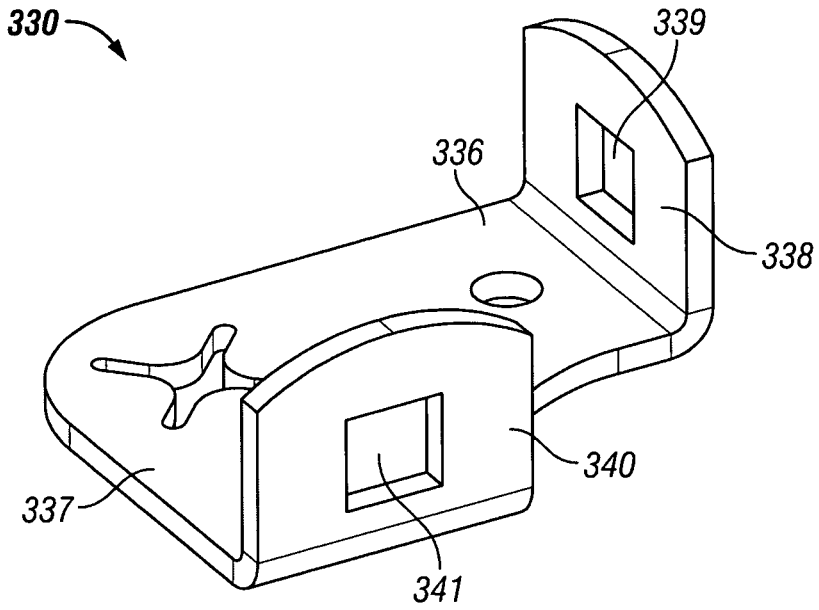
FIG. 25 is a front pictorial view of a 90 degree corner connector for connecting a narrow partition to a wide partition.
Figure 26:
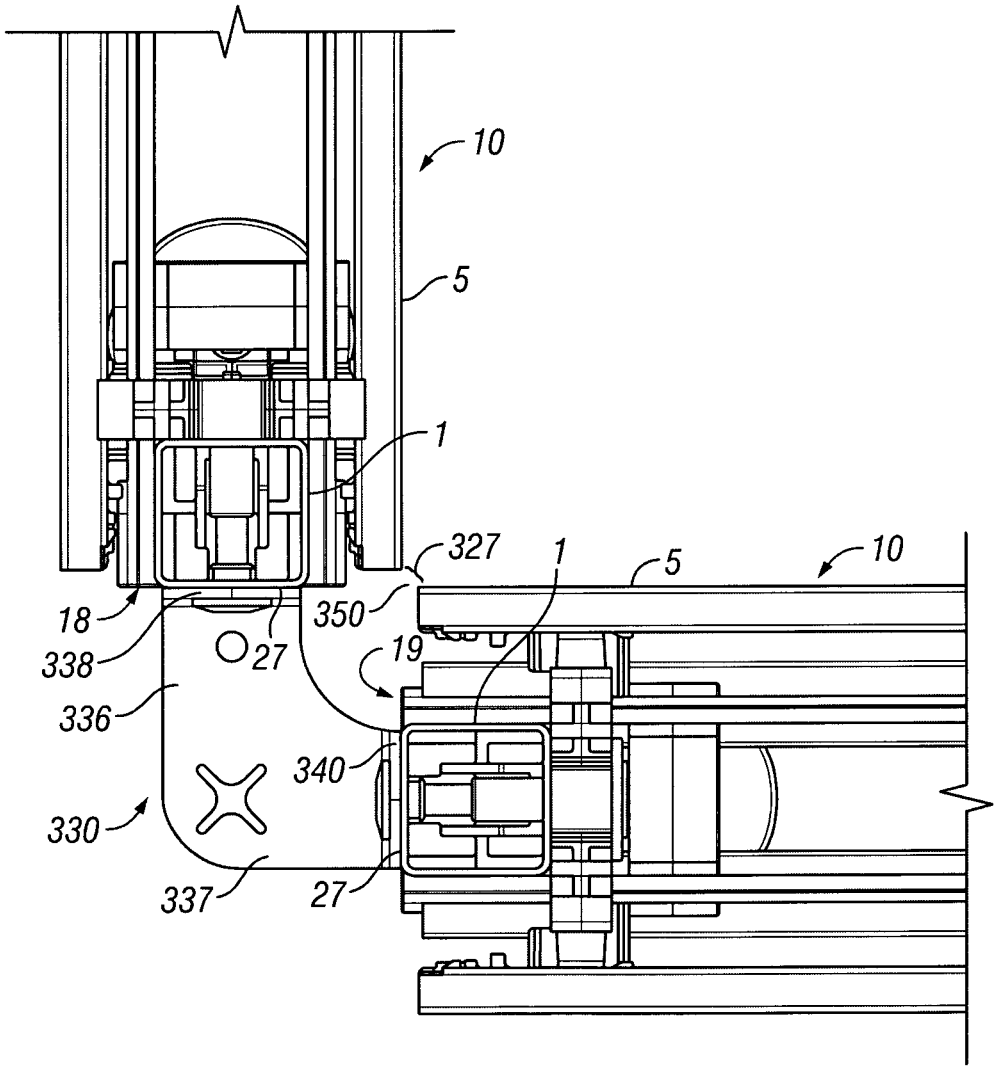
FIG. 26 is a schematic top view showing the narrow to wide corner connector of FIG. 25 connecting a narrow partition to a wide partition.

Reference is made to FIG. 25 which illustrates a corner connector 330 adapted for use to connect, as seen in FIG. 26, to connect partitions 10 of different widths. As seen in FIG. 26, the connector 330 is L-shaped having a longer arm 336 and a shorter arm 337. At the end of the longer arm 336, there is provided an upstanding flange 338 with an opening 339. At the end of the shorter arm 337, there is provided an upstanding flange 340 with an opening 341. As seen in FIG. 26, the flange 340 is secured against the surface 27 of the post 1 at the second end edge 19 of the frame 12 of a wide partition 10 via a similar nut and bolt arrangement as seen in FIG. 24. The flange 338 is secured against the surface 27 of the post 1 at the first end edge 18 of the frame 12 of an arrow partition. With the arms 336 and 337 being of different lengths, the planes of the surfaces 27 of each of the posts intersect at a suitable point indicated as 350 in FIG. 26 so as to provide a suitable gap 327 between the adjacent covers 5 on each of the two different width partitions. The connector 330 of FIG. 25 can be inverted and rotated 180 degrees, for example, if the relative positions of the thin partition and the wide partition are to be reversed.

Various other connectors may be provided so as to connect the ends of the frames together at angles other than 90 degrees with use of suitable brackets comparable to known brackets. Various edge trims may be provided such as the top trims indicated as 906 and 907 in FIG. 1 and the end trims such as 949 and 950 in FIG. 1 which top and end trims may be selected to have suitable widths to correspond with the width of the particular partitions 10 to which they are to be coupled.

The cover retaining clips in accordance with the first preferred embodiment as shown in FIGS. 7 to 9 and 14 to 16 are removably coupled to a rail 2 or to a leg assembly 22.

In the preferred embodiment, the top clips 102 and 302 provide for coupling of an upper edge of a front cover 5F and an upper edge of a rear cover 5R. These top clips 103 and 203 also provide for coupling of a top trim such as 906 in FIG. 1. The bottom clips 103 and 203 are two-way and providing for coupling of a lower edge of a front cover and the lower edge of a rear cover. The intermediate clips 101 and 201 may be considered four-way in providing for connection to the upper edge of a front cover, the upper edge of a rear cover, the lower edge of a front cover and the lower edge of a rear cover. It is to be appreciated that one unitary top clip 102 or 202 could be replaced by two separate top clips, one for securing a front cover and a second for securing a rear cover. Similarly, each of the bottom clips 103 and 203 could be replaced by two separate clips, one for securing a front cover and the other for securing a rear cover. Each intermediate clip 101 and 201 could be replaced by a number of clips. For example, one intermediate clip could be replaced by four separate clips with a first of the clips for connection of the upper end of a front panel, a second clip for the connection of the upper edge of a rear panel, a third clip for the connection of the lower edge of a front panel and a fourth clip for the connection of the upper edge of a rear panel. Alternatively, the intermediate clips could be replaced by two two-way clips, a first two-way clip connecting the upper ends of the front cover and the upper end of the rear cover and a second two-way clip connecting the lower end of a front cover and the lower end of a rear cover. Alternatively, an intermediate clip could be replaced by two two-way clips, one for each face with a first two-way clip connecting the upper end of one front panel and the lower end of another front panel and a second two-way clip which connects an upper end of a rear panel and a lower end of another rear panel.

Each of these above-mentioned clips whether they provide for one-way, two-way or four-way coupling to covers may be independently secured to the frame as, for example, by being secured to the rail 2 or to the post 1. When secured to the rail 2, it is advantageous that as shown in the preferred first embodiment, the clips engage both beams of the rail, however, this is not necessary and a clip may merely engage one of the side beams of a rail.

Figure 10:
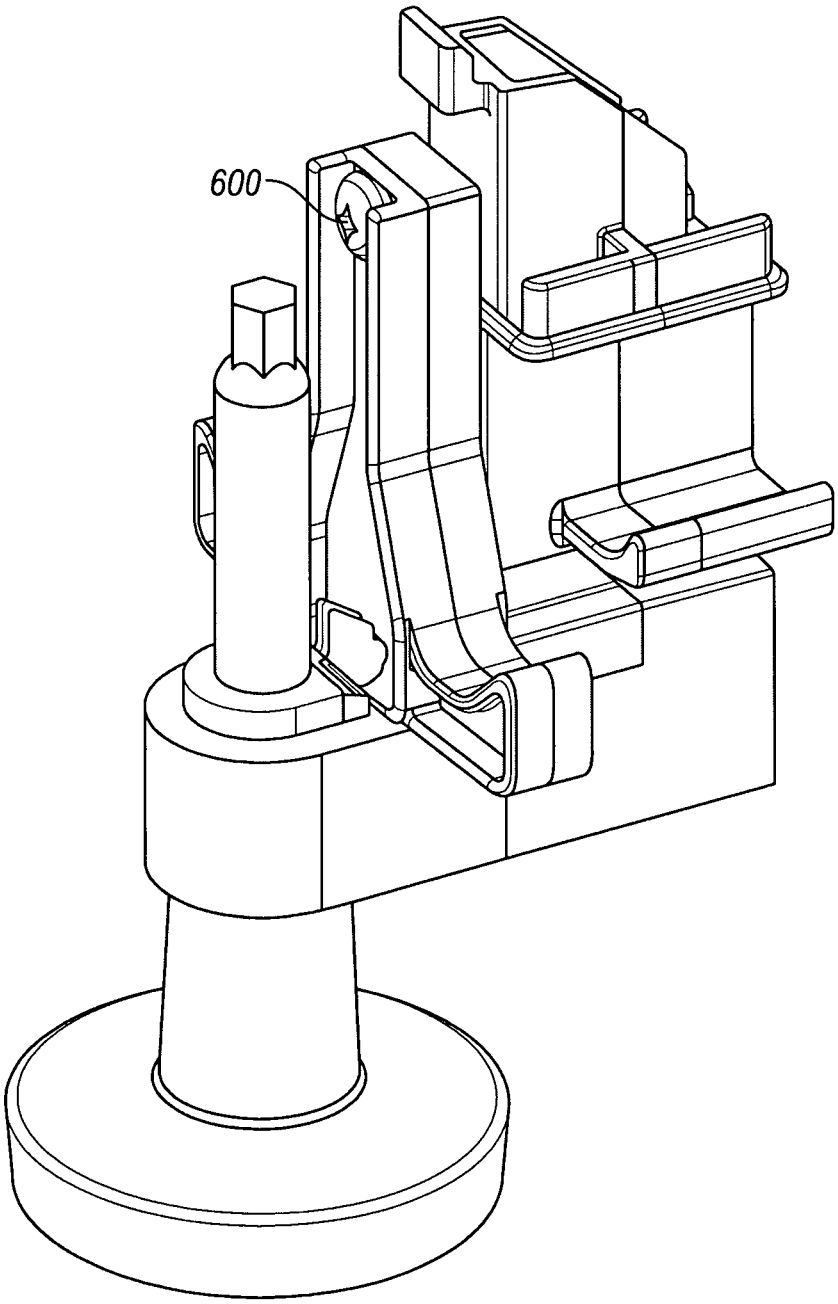
FIG. 10 is a perspective view showing the bottom wide clip of FIG. 9 as secured to a foot assembly of FIG. 6.

Each clip may be secured to a post rather than to the rail. For example, clips similar to the two-way and four-way clips illustrated in the preferred embodiment could be secured to the frame by engagement with the inside surface 26 of a post 1. Alternately, each of such clips could be secured to a front surface 51 or the rear surface 52 of the post. The manner of removable connection of the clips to the frame as to the post 1 or rail 2 is not limited. In the preferred embodiment, the top clips 102 and 202 and the intermediate clips 101 and 201 are secured in a friction-fit manner to a rail 2 by frictional engagement between the two beams of the rail. Various apertures may be provided in the rail or the post into which the clips could be secured without additional securement or with additional securement such as with screws in a similar manner that the bottom clips 103 and 203 are secured to the leg assembly 2 via screws 600 as seen in FIG. 10. Each of the clips could merely be secured to the post as to the front surface 51, rear surface 52 or the inside surface 56 as by screws.

In the first preferred embodiment, each of the clips which are to be provided as two replaceable exchangeable elements, namely as a wide clip and as a narrow clip. However, it is possible that a single clip could be provided which is mountable to the frame in a first position such that the clip serves the purpose of a wide clip and in a second position such that the same clip serves the purpose of a narrow clip. For example, insofar as a single clip serving the purpose of engaging the upper end of a front cover may be secured to the inside surface 26 of the post 1 as by one or more screws, the post could be provided with two apertures for the screw, with one aperture locating the clip so it serves as a wide clip and the other aperture locating the clip so that it serves as a narrow aperture. In this manner, by the use of a single removable clip and securing the clip to the frame at two different positions, the same clip can be used to mount a cover either in the remote position or the proximate position.

Figure 27:
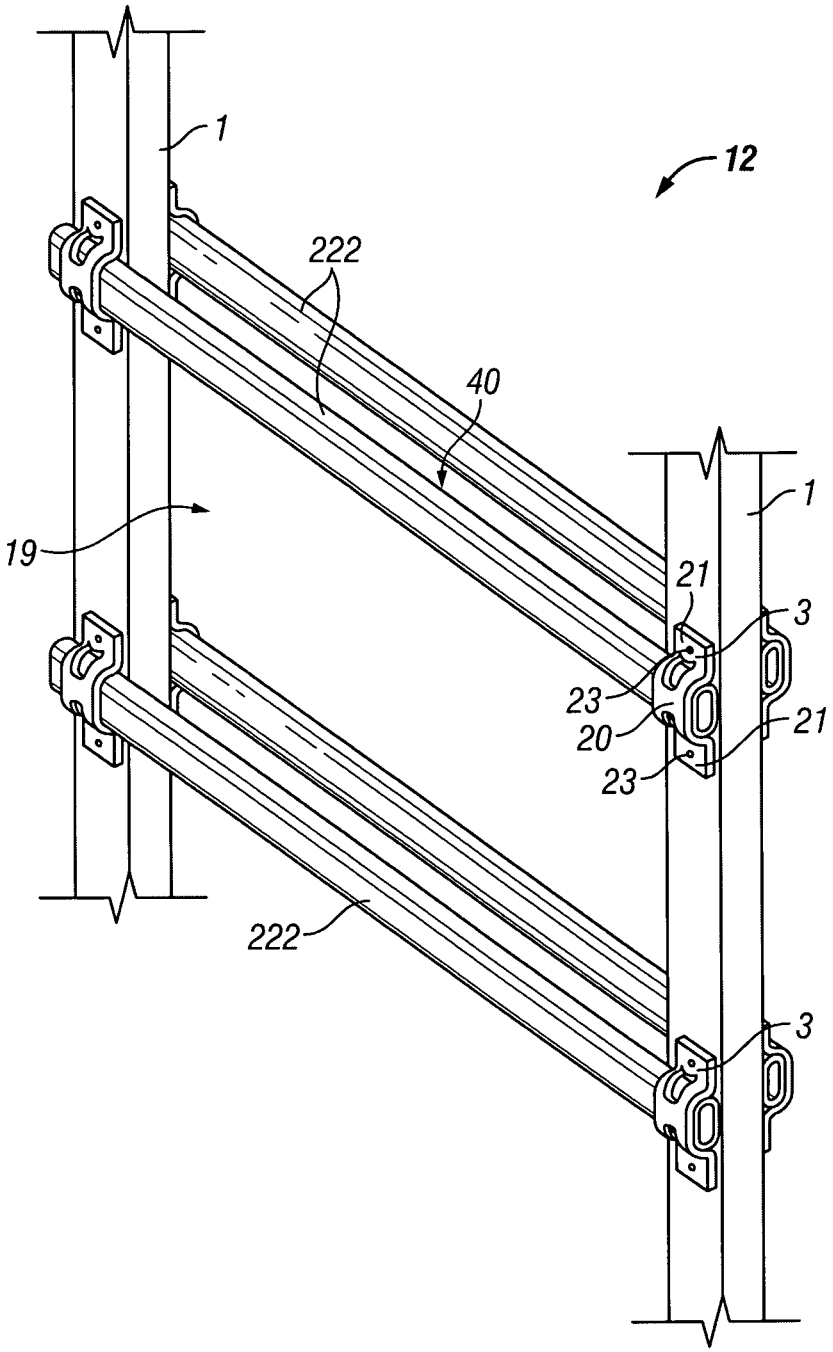
FIG. 27 is a partial pictorial view of a frame for a partition in accordance with a second embodiment of the invention.

Reference is made to FIGS. 27 to 30 showing an arrangement in accordance with a second embodiment of the present invention adopting a frame 12 for a partition having a construction as disclosed in U.S. Pat. No. 5,813,178 issued Sep. 29, 1998 the disclosure of which is hereby adopted by reference. FIG. 27 schematically illustrates a truncated vertical section of a frame 12 with two vertically spaced posts 1 joined by pairs of horizontally extending beams 222. The beams 222 are arranged in parallel pairs on both sides of the posts 1. The beams 222 are connected to front face and the rear face of each post 1 in an overlapping moment resisting rigid connection by brackets 3 having a saddle portion 20 of internal profile mating the external profile of the beams 2 and flange portions 21 above and below the saddle portion 20. The flange portions 21 lie over and are connected to the front or rear face of the associated posts 1 with screws 23. This frame 12 has the advantage that the central post space 40 extends uninterrupted the entire height of the frame 12.

Figure 28:
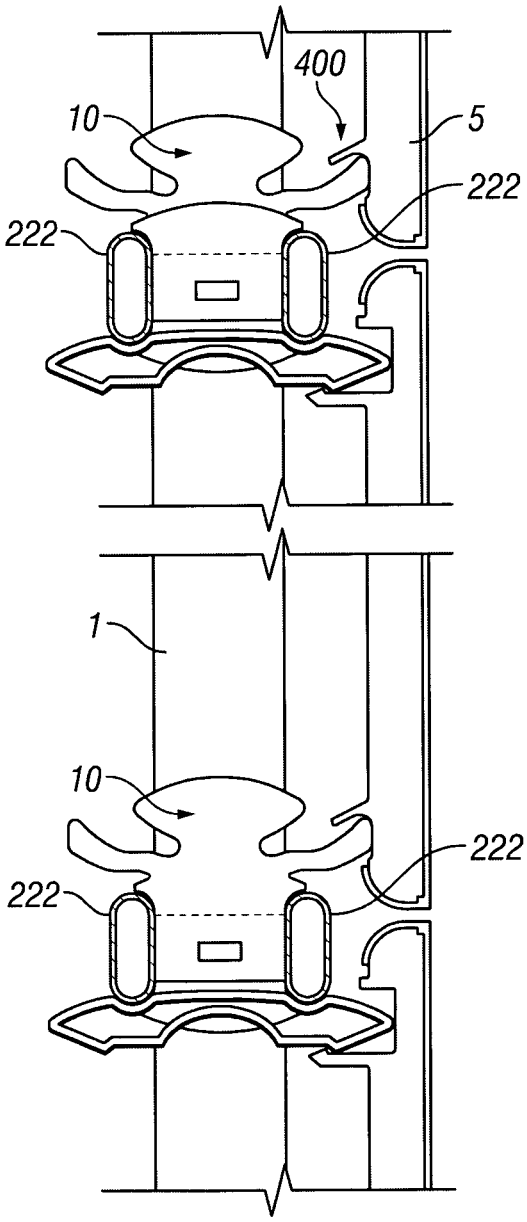
FIG. 28 is a schematic end view of the frame of FIG. 27 showing covers coupled to one side thereof by wide clips.
Figure 29:
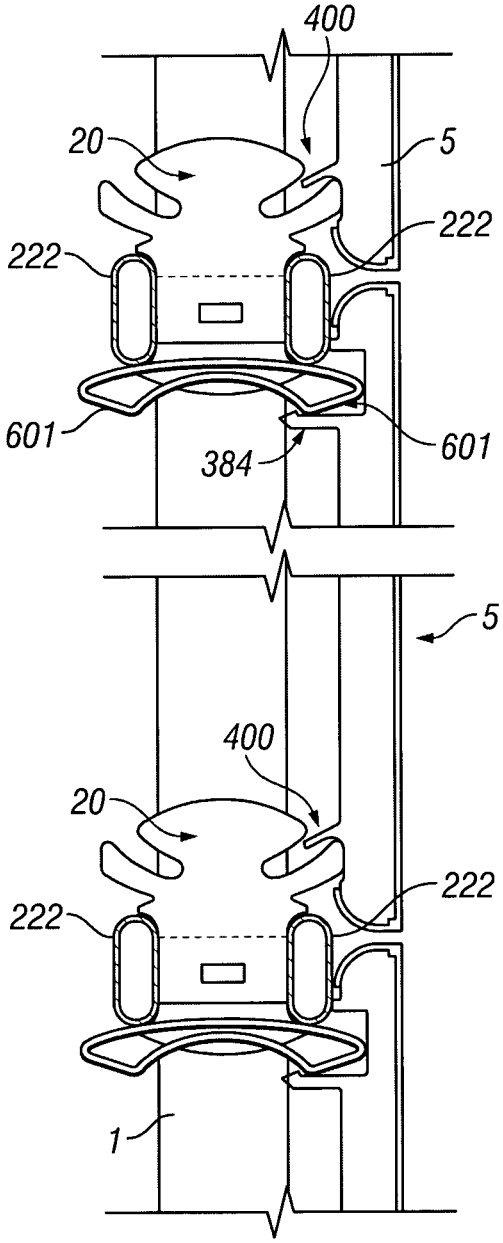
FIG. 29 is an end view the same as FIG. 28 but with narrow clips.

FIG. 28 shows a schematic end view of the section of frame 12 shown in FIG. 27 with cover retaining intermediate wide clips 103 similar to the intermediate wide clips 103 shown in the first embodiment. In FIG. 28, covers 5 are shown attached to the wide clips 103 on the front face of the frame. The wide clips 103 are manually removable and held in a friction fit between the beams 222. FIG. 29 shows the same schematic end view of the section of frame 12 as in FIG. 28 but with cover retaining intermediate narrow clips 203 similar to the intermediate narrow clips 203 shown in the first embodiment. In FIG. 29, covers 5 are shown attached to the narrow clips 203 on the front face of the frame. The narrow clips 203 are also manually removable and held in a friction fit between the beams 222. In FIGS. 28 and 29, the covers 5 are shown attached to the wide clips 103 on merely the right side of the frame 12 for ease of illustration. The partition 10 in FIG. 28 has a width greater than the width of the partition 10 in FIG. 29.

Figure 30:
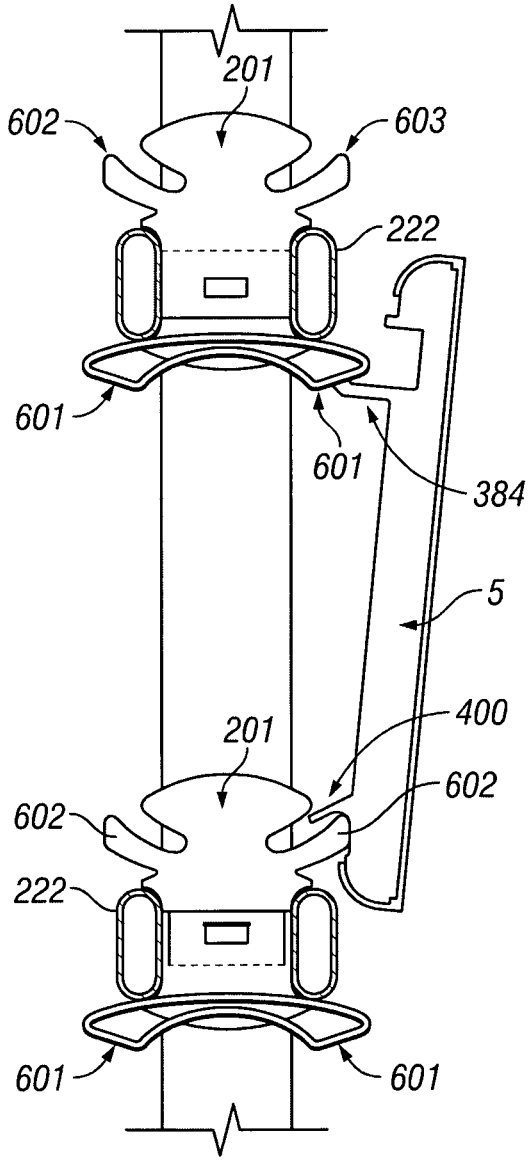
FIG. 30 is a schematic end view of the frame of FIG. 27 shown in the manner in which a cover is removably engaged with the clips on the frame.

Referring to FIG. 30, each intermediate narrow clip 201 has a pair of lower legs 601 which extend outwardly and serve to engage and retain an upper end of a cover 5.

Each intermediate clip 201 has a pair of upper legs 602 which extend outwardly and serve to engage and retain a lower end of a cover 5.

As seen in FIG. 30, the lower end of the cover 5 carries a downwardly extending leg 400 forming a slotway 401 therebelow. The leg 400 engages over the upper leg 602 of the clip 201 such that the upper leg 602 is received in the slotway 401. With the upper leg 602 engaged in the slotway 401 of a lower clip as seen in FIG. 30, the cover is pivoted counter-clockwise about the upper leg 602 to bring a hook member 384 on the upper end of the cover 5 into engagement with a lower surface of the lower leg 601 of an upper clip. The lower leg 601 is resilient and a user may manually force the hook member 384 to an engaged position on the lower leg 601 in which the cover 5 is vertical as shown in FIG. 29. This coupling arrangement is described in above-mentioned U.S. Pat. No. 5,813,178.

In accordance with the present invention the partition may have a frame selected to meet various needs including to provide aesthetically appearing widths or to accommodate capacity for or ease of passage of wiring. Narrower width partitions may be selected where a lower capacity for passage of wiring or a lesser ease of passage of wiring is satisfactory. With the present invention, however, the same frame and covers may be readily reconfigured from a narrower width configurations to one or more greater width configurations to provide increased capacity for passage of wiring and a greater ease of passage of wiring.

The first preferred embodiment shows the use of a set of wide clips such as 101 and a set of narrow clips such as 201 to provide a partition which can be configured to have one of two different widths. Additional sets of clips of different widths such as extra wide clips of greater width than the wide clips can be provided such that the partition can be configured to have three or more different widths.

Figure 31:
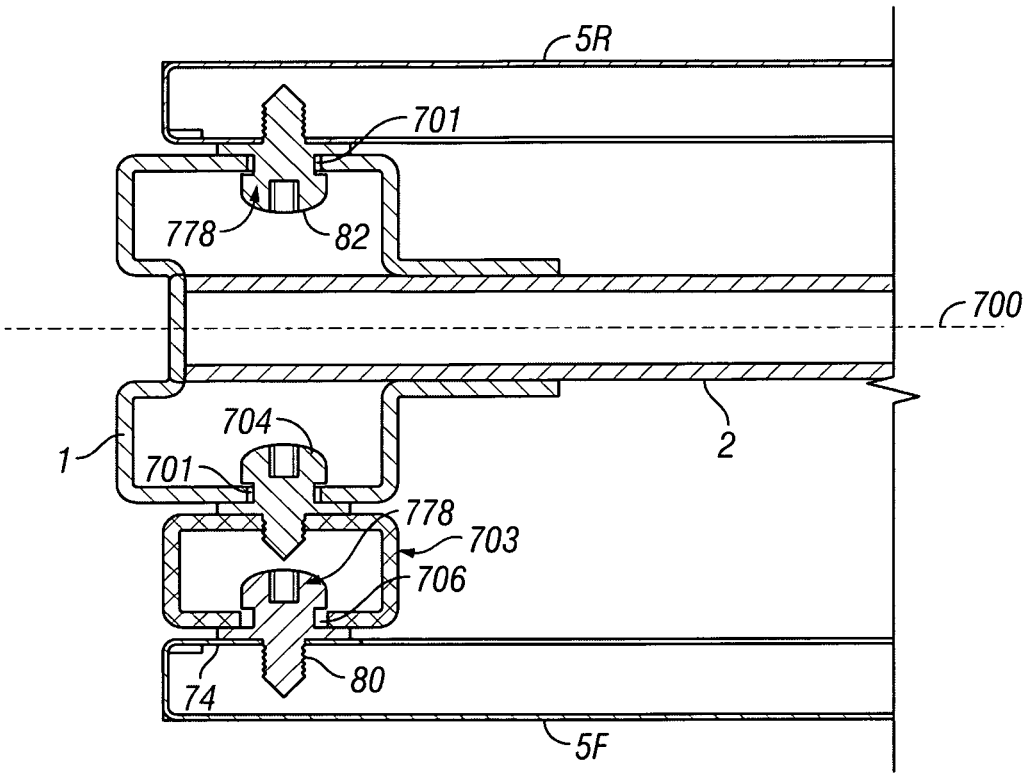
FIG. 31 shows a schematic horizontal cross-sectional view of a partition in accordance with a fourth embodiment of the present invention.

Reference is made to FIG. 31 showing partial horizontal cross-sectional view of a partition 10 of the type disclosed in U.S. Patent Publication 2010/0307080 published Dec. 9, 2010, the disclosure of which is incorporated herein by reference. This publication teaches the partition 10 having a frame 12 of vertical posts 1 and horizontal beams 2 with a rear cover 5R removably secured to the posts 1 via hook members 778 received in keyway slots 701 in the front face 51 of the posts 1 as seen in the top rear half of FIG. 31 above dashed line 700.

An arrangement in accordance with the present invention is shown below the lien 700 with a spacer clip 703 being removably secured to the post by a hook member 704 received in the post keyhole slot 701 and the clip 703 having an outwardly spaced surface 705 carrying a keyhole slot 706 within which the hook member 778 on the front cover 5F may engage. By the use of such clips 703, the partition may be provided to have a different width.

The present invention has been described with reference to preferred embodiments. Many modifications and variations will now occur to a person skilled in the art. For a definition of the invention, reference is made to the following claims.

We claim:

1. A freestanding, portable variable width partition for open offices spaces, comprising:

(a) a skeleton frame having two opposite faces, a foot portion adapted to abuttingly support said partition on a floor surface, and orthogonally related top, bottom and two end edges, at least one of said two end edges being shaped for direct connection with a corresponding end edge on an adjacent partition to create a substantially freestanding utility panel system;

said skeleton frame including spaced apart, parallel vertical frame members and spaced apart, parallel horizontal frame members that extend generally orthogonally to said vertical frame members, said vertical frame members being rigidly secured to at least one of the horizontal frame members, and said horizontal frame members being rigidly secured to at least one of the vertical frame members, said two opposite faces of the skeleton frame comprise a front face and a rear face, (b) a plurality of covers, each cover shaped to cover at least a portion of one of the faces of said skeleton frame, the covers comprise at least one front cover to cover the front face and at least one rear cover to cover the rear face, (c) a plurality of clips comprising a set of remote clips and a set of proximate clips, each remote clip of the remote set of clips being removably attachable to the frame for replacement by a corresponding proximate clip of the set of the proximate clips and each proximate clip of the set of proximate clips being removably attachable to the frame for replacement by a corresponding remote clip of the set of remote clips, each cover being detachably connectable with the clips to the skeleton frame for detachment to provide ready access to an interior portion of said partition, each cover is detachably secured to the frame with either the proximate clips or in the alternative with the remote clips, wherein (i) when the remote clips are coupled to the frame, when each cover is detachably connected to the frame with the remote clips, each cover is in a first proximate position and in the alternative (ii) when the proximate clips are coupled to the frame, when each cover is detachably connected to the frame with the remote clips each cover is in a second remote position, in both the first proximate position and the second remote position each cover covers the same respective portion of one of the faces, each front cover in the remote position is spaced forwardly from the frame a greater extent than when the front cover is in the proximate position, each rear cover in the remote position is spaced rearwardly from the frame a greater extent than when the rear cover is in the proximate position, at least one front cover having a forwardly directed surface forming a front face of the partition when the front cover is connected to the frame in the proximate position and the remote position, the at least one rear cover having a rearwardly directed surface forming a rear face of the partition when the rear cover is connected to the frame in the proximate position and the remote position, the partition having a width from the front face of the partition to the rear face of the partition, wherein when each said front cover and each said rear cover is connected to the frame in the proximate position the width of the frame is a first width, and in the alternative when each said front cover and each said rear cover is connected to the frame in the remote position the width of the frame is a second width greater than the first width.

2. A partition as claimed in claim 1 wherein said vertical frame members defining a central space therebetween that extends between the top and bottom edges of the skeleton frame, and said horizontal frame members defining at least one utility management raceway between adjacent horizontal frame members extending between the two end edges of the skeleton frame, the central space and the utility management raceway being in communication, each front cover and each rear cover when connected to the frame in the remote position defining a portion of the utility management raceway, whereby utilities can be selectively and conveniently routed through the central space and the utility management raceway the entire height of the space frame, the entire width of the space frame, and to adjacent partitions.

3. A partition as claimed in claim 1 wherein said skeleton frame comprising as a central layer the spaced apart, parallel vertical frame members with as an exterior front layer an external front set of the horizontal frame members and as an exterior rear layer an external rear set of the horizontal frame members, said external front set of frame members defining at least one front utility management raceway in said front layer and said external rear set of frame members defining at least one rear utility management raceway in said rear layer, the front and rear utility management raceways being defined between the adjacent external frame members in the front and rear layers and extending between the two end edges of the skeleton frame, the central space and the first and second utility management raceways being in communication, each cover defining a portion of one of the utility management raceways, whereby utilities can be selectively and conveniently routed through the central space and the front and rear utility management raceways the entire height of the space frame, the entire width of the space frame, and to adjacent partitions.

4. A partition as claimed in claim 1 wherein each front cover when connected to the frame in the remote position is spaced outwardly from the vertical frame members defining a front space between each vertical frame member and each front frame member through which utilities can be routed to the two end edges of the partition, and each rear cover when connected to the frame in the remote position is spaced outwardly from the vertical frame members defining a rear space between each vertical frame member and each rear frame member through which utilities can be routed to the two end edges of the partition.

5. A partition as claimed in claim 1 wherein each front cover when connected to the frame in the remote position is spaced outwardly from the vertical frame members defining a front space between each vertical frame member and each front frame member through which utilities can be routed to adjacent partitions, and each rear cover when connected to the frame in the remote position is spaced outwardly from the vertical frame members defining a rear space between each vertical frame members and each rear frame member through which utilities can be routed to adjacent partitions.

6. A partition as claimed in claim 5 wherein said vertical frame members defining a central space therebetween that extends between the top and bottom edges of the skeleton frame, and said horizontal frame members defining at least one utility management raceway between adjacent horizontal frame members extending between the two end edges of the skeleton frame, the central space and the utility management raceway being in communication, each front cover and each rear cover when connected to the frame in the remote position defining a portion of the utility management raceway, whereby utilities can be selectively and conveniently routed through the central space and the utility management raceway the entire height of the space frame, the entire width of the space frame, and through the front space and/or the rear space to adjacent partitions.

7. A partition as claimed in claim 1 wherein each front cover when connected to the frame in the remote position is spaced outwardly from the vertical frame members defining a front space between each vertical frame member and each front frame member through which utilities can be routed to adjacent partitions from the interior portion of the partition, and each rear cover when connected to the frame in the remote position is spaced outwardly from the vertical frame members defining a rear space between each vertical frame member and each rear frame member through which utilities can be routed to adjacent partitions from the interior portion of the partition.

8. A partition as claimed in claim 7 wherein said vertical frame members defining a central space therebetween that extends between the top and bottom edges of the skeleton frame, and said horizontal frame members defining at least one utility management raceway between adjacent horizontal frame members extending between the two end edges of the skeleton frame, the central space and the utility management raceway being in communication, each front cover and each rear cover when connected to the frame in the remote position defining a portion of the utility management raceway, whereby utilities can be selectively and conveniently routed through the central space and the utility management raceway the entire height of the space frame, the entire width of the space frame, and through the front space and/or the rear space to adjacent partitions.

9. A partition as claimed in claim 1 wherein each clip is removably coupled to the frame adjacent an inner surface of one of the vertical members.

10. A partition as claimed in claim 1 wherein each clip is removably coupled to the frame by frictional engagement with horizontal frame members adjacent an inner surface of one of the vertical members.

11. A partition as claimed in claim 1 wherein the remote clips comprise a two way remote clip that engages simultaneously both one of the front covers and one of the rear covers and the proximate clips comprise a two way proximate clip that engages both one of the front covers and one of the rear covers.

12. A partition as claimed in claim 11 wherein each clip is removably coupled to the frame adjacent an inner surface of one of the vertical members.

13. A partition as claimed in claim 1 wherein each clip is removably coupled with a removable threaded fastener to an inner or outer surface of one of the vertical members locating the clip proximate one of the horizontal frame members.

14. A partition as claimed in claim 1 wherein the clips comprise a two way clip that is removably coupled with a removable threaded fastener to an inner or outer surface of one of the vertical members locating the clip proximate one of the a horizontal frame members and the two way clip comprises either a two way remote clip that engages simultaneously both one of the front covers and one of the rear covers or a two way proximate clip that engages both one of the front covers and one of the rear covers.

15. A partition as claimed in claim 1 wherein the clips comprise a two way clip removably coupled to the frame by frictional engagement with horizontal frame members adjacent an inner surface of one of the vertical members and the two way clip comprises either a two way remote clip that engages simultaneously both one of the front covers and one of the rear covers or a two way proximate clip that engages both one of the front covers and one of the rear covers.

* * * * *